US011737197B2

(12) United States Patent
Wang

(10) Patent No.: US 11,737,197 B2
(45) Date of Patent: Aug. 22, 2023

(54) LIGHT MIXING ADJUSTMENT METHOD, DEVICE AND SYSTEM, AND STORAGE MEDIUM

(71) Applicant: SHENZHEN LIGHTSPOT TECHNOLOGY LIMITED, Shenzhen (CN)

(72) Inventor: Jixiang Wang, Shenzhen (CN)

( * ) Notice: Subject to any disclaimer, the term of this patent is extended or adjusted under 35 U.S.C. 154(b) by 0 days.

(21) Appl. No.: 17/616,625

(22) PCT Filed: Jun. 5, 2020

(86) PCT No.: PCT/CN2020/094740

§ 371 (c)(1),
(2) Date: Dec. 3, 2021

(87) PCT Pub. No.: WO2020/244643

PCT Pub. Date: Dec. 10, 2020

(65) Prior Publication Data

US 2022/0232686 A1 Jul. 21, 2022

(30) Foreign Application Priority Data

Jun. 5, 2019 (CN) ..... 201910495583.2

(51) Int. Cl.
*H05B 47/165* (2020.01)
*H05B 47/155* (2020.01)
*H05B 45/20* (2020.01)

(52) U.S. Cl.
CPC ..... *H05B 47/165* (2020.01); *H05B 47/155* (2020.01); *H05B 45/20* (2020.01)

(58) Field of Classification Search
CPC .... H05B 47/165; H05B 47/155; H05B 45/20; H05B 47/16; H05B 47/11; H05B 47/10
See application file for complete search history.

(56) References Cited

U.S. PATENT DOCUMENTS

2016/0295658 A1* 10/2016 Chraibi ..... F21V 19/006

FOREIGN PATENT DOCUMENTS

CN 103889101 A * 6/2014
WO WO-2009093191 A2 * 7/2009 ..... F21S 8/006

OTHER PUBLICATIONS

Lai et al., English translation of CN-103889101-A, PE2E Search version, Jun. 25, 2014 (Year: 2014).*

(Continued)

*Primary Examiner* — Daniel D Chang
(74) *Attorney, Agent, or Firm* — Raymond Y. Chan; David & Raymond Patent Firm

(57) ABSTRACT

The embodiment of the present application provides a light mixing adjustment method, device and system as well as a storage medium. The light mixing adjustment method comprises: acquiring at least two main control light sources and at least two auxiliary light sources; adjusting the proportional relation of luminous flux between the at least two main control light sources and the at least two auxiliary light sources to obtain target mixed light with a target color temperature, so that the color coordinates of the target mixed light are within the preset color coordinate range. The target mixed light is obtained by mixing the at least two main control light sources and the at least two auxiliary light sources; and the total luminous flux of all the main control light sources is greater than the total luminous flux of all the auxiliary light sources. According to the embodiment of the present application, at least two auxiliary light sources are added on the basis of at least two main control light sources, and the proportional relation of luminous flux between a plurality of light sources is adjusted, so that the plurality of light sources can be mixed to obtain target mixed light satisfying the demands.

2 Claims, 16 Drawing Sheets

(56) References Cited

OTHER PUBLICATIONS

Lai et al., English translation of CN-103889101-A, Foreign Patent Finder version, Jun. 25, 2014 (Year: 2014).*

* cited by examiner

| | light mixing proportion | | mixed color | color coordinate | | CRI | | | | | | | | | | | | | | | | | TM-30-18 | | |
|---|---|---|---|---|---|---|---|---|---|---|---|---|---|---|---|---|---|---|---|---|---|---|---|---|---|
| | 2678K | 5625K | temperature(K) | x | y | Ra | R1 | R2 | R3 | R4 | R5 | R6 | R7 | R8 | R9 | R10 | R11 | R12 | R13 | R14 | R15 | Rf | Rg | TLCI |
| luminous flux ratio | 100.00% | 0.00% | 2678 | 0.4619 | 0.4111 | 98 | 98 | 99 | 96 | 97 | 98 | 98 | 99 | 99 | 95 | 99 | 94 | 93 | 98 | 97 | 99 | 96 | 100 | 98 |
| | 90.00% | 10.00% | 2839 | 0.4478 | 0.4058 | 97 | 96 | 98 | 97 | 96 | 96 | 96 | 99 | 99 | 99 | 98 | 93 | 94 | 96 | 97 | 98 | 97 | 101 | 99 |
| | 80.00% | 20.00% | 3020 | 0.4325 | 0.3972 | 96 | 95 | 97 | 98 | 95 | 95 | 95 | 99 | 98 | 95 | 95 | 992 | 92 | 95 | 98 | 96 | 97 | 102 | 99 |
| | 70.00% | 30.00% | 3224 | 0.4177 | 0.3889 | 96 | 94 | 96 | 99 | 94 | 94 | 94 | 99 | 96 | 90 | 93 | 91 | 91 | 94 | 98 | 94 | 97 | 102 | 99 |
| | 60.00% | 40.00% | 3456 | 0.4036 | 0.381 | 95 | 93 | 96 | 99 | 94 | 93 | 93 | 99 | 95 | 87 | 92 | 91 | 91 | 93 | 98 | 93 | 97 | 103 | 99 |
| | 50.00% | 50.00% | 3718 | 0.3738 | 0.3698 | 95 | 93 | 95 | 99 | 93 | 93 | 93 | 99 | 99 | 94 | 84 | 91 | 91 | 90 | 93 | 99 | 96 | 103 | 99 |
| | 40.00% | 60.00% | 4015 | 0.377 | 0.366 | 95 | 93 | 95 | 99 | 94 | 93 | 93 | 99 | 93 | 82 | 91 | 91 | 91 | 93 | 99 | 92 | 96 | 102 | 99 |
| | 30.00% | 70.00% | 4350 | 0.3645 | 0.359 | 95 | 93 | 95 | 99 | 94 | 93 | 94 | 98 | 93 | 81 | 91 | 91 | 91 | 93 | 99 | 92 | 97 | 102 | 99 |
| | 20.00% | 80.00% | 4728 | 0.3524 | 0.3522 | 95 | 93 | 96 | 99 | 95 | 94 | 95 | 98 | 94 | 82 | 92 | 92 | 92 | 94 | 99 | 92 | 97 | 102 | 99 |
| | 10.00% | 90.00% | 5151 | 0.3394 | 0.349 | 96 | 94 | 96 | 99 | 94 | 94 | 95 | 99 | 95 | 85 | 92 | 92 | 93 | 94 | 99 | 93 | 97 | 102 | 99 |
| | 0.00% | 100.00% | 5625 | 0.3296 | 0.3448 | 97 | 95 | 97 | 99 | 95 | 95 | 96 | 99 | 96 | 88 | 93 | 93 | 95 | 95 | 99 | 95 | 97 | 102 | 100 |

FIG. 13

| | light mixing proportion | | | | | mixed color | color coordinate | | CRI | | | | | | | | | | | | | | | TM-30-18 | | |
|---|---|---|---|---|---|---|---|---|---|---|---|---|---|---|---|---|---|---|---|---|---|---|---|---|---|---|
| | 2678K | 5625K | 570nm | 505nm | 484nm | temperature(K) | x | y | Ra | R1 | R2 | R3 | R4 | R5 | R6 | R7 | R8 | R9 | R10 | R11 | R12 | R13 | R14 | R15 | Rf | Rg | TLCI |
| luminous flux ratio | 100.00% | 0.00% | 0.00% | 0.00% | 0.00% | 2678 | 0.4639 | 0.4149 | 98 | 98 | 99 | 96 | 97 | 98 | 98 | 99 | 99 | 95 | 99 | 94 | 93 | 98 | 97 | 99 | 96 | 100 | 98 |
| | 98.00% | 0.00% | 1.10% | 0.50% | 0.40% | 2741 | 0.4593 | 0.4147 | 98 | 97 | 99 | 98 | 97 | 98 | 97 | 98 | 98 | 97 | 98 | 95 | 93 | 97 | 98 | 99 | 94 | 98 | 98 |
| | 86.00% | 10.00% | 2.80% | 0.80% | 0.40% | 2941 | 0.4421 | 0.4074 | 98 | 98 | 99 | 99 | 98 | 98 | 97 | 98 | 99 | 98 | 98 | 96 | 93 | 98 | 98 | 98 | 95 | 99 | 99 |
| | 76.00% | 20.00% | 2.90% | 1.10% | 0.00% | 3118 | 0.4288 | 0.4012 | 98 | 98 | 99 | 98 | 97 | 98 | 97 | 99 | 99 | 99 | 98 | 95 | 94 | 98 | 98 | 98 | 97 | 100 | 99 |
| | 65.00% | 30.00% | 3.70% | 1.10% | 0.20% | 3364 | 0.4124 | 0.3926 | 98 | 97 | 98 | 99 | 98 | 97 | 97 | 99 | 99 | 97 | 97 | 96 | 94 | 98 | 99 | 97 | 97 | 100 | 99 |
| | 54.00% | 40.00% | 5.70% | 1.30% | 0.00% | 3605 | 0.3996 | 0.3879 | 99 | 100 | 99 | 100 | 99 | 99 | 99 | 99 | 99 | 99 | 100 | 99 | 94 | 100 | 99 | 99 | 97 | 100 | 99 |
| | 43.00% | 50.00% | 5.70% | 1.30% | 0.00% | 3905 | 0.3848 | 0.3795 | 99 | 100 | 99 | 99 | 99 | 98 | 99 | 99 | 99 | 99 | 100 | 99 | 93 | 100 | 99 | 99 | 97 | 101 | 99 |
| | 33.00% | 60.00% | 5.80% | 1.20% | 0.00% | 4209 | 0.3719 | 0.3719 | 99 | 98 | 98 | 100 | 98 | 98 | 97 | 99 | 98 | 94 | 97 | 97 | 93 | 98 | 99 | 97 | 97 | 100 | 99 |
| | 24.00% | 70.00% | 4.70% | 1.30% | 0.00% | 4548 | 0.3594 | 0.3638 | 99 | 99 | 99 | 100 | 99 | 99 | 98 | 98 | 99 | 98 | 98 | 99 | 92 | 99 | 100 | 98 | 98 | 101 | 99 |
| | 14.00% | 80.00% | 4.10% | 1.90% | 0.00% | 4988 | 0.3459 | 0.3569 | 99 | 99 | 99 | 98 | 98 | 99 | 99 | 98 | 98 | 99 | 97 | 99 | 92 | 98 | 99 | 98 | 98 | 101 | 99 |
| | 5.00% | 90.00% | 3.60% | 1.40% | 0.00% | 5392 | 0.3351 | 0.3495 | 99 | 99 | 99 | 99 | 99 | 99 | 98 | 99 | 99 | 99 | 97 | 97 | 97 | 99 | 99 | 99 | 98 | 100 | 99 |
| | 0.00% | 100.00% | 0.00% | 0.00% | 0.00% | 5625 | 0.3296 | 0.3394 | 97 | 95 | 97 | 99 | 95 | 95 | 96 | 99 | 96 | 88 | 93 | 93 | 95 | 95 | 99 | 95 | 97 | 102 | 100 |

FIG. 14

| | light mixing proportion | | mixed color | color coordinate | | CRI | | | | | | | | | | | | | | | | TM-30-18 | | |
|---|---|---|---|---|---|---|---|---|---|---|---|---|---|---|---|---|---|---|---|---|---|---|---|---|
| | 3212K | 5545K | temperature(K) | x | y | Ra | R1 | R2 | R3 | R4 | R5 | R6 | R7 | R8 | R9 | R10 | R11 | R12 | R13 | R14 | R15 | Rf | Rg | TLCI |
| luminous flux ratio | 100.00% | 0.00% | 3212 | 0.4231 | 0.3997 | 99 | 98 | 99 | 98 | 98 | 98 | 98 | 100 | 99 | 99 | 99 | 96 | 97 | 98 | 98 | 99 | 98 | 100 | 99 |
| | 90.00% | 10.00% | 3336 | 0.4126 | 0.3934 | 98 | 98 | 99 | 98 | 97 | 98 | 98 | 100 | 98 | 97 | 98 | 96 | 97 | 98 | 98 | 98 | 98 | 101 | 99 |
| | 80.00% | 20.00% | 3535 | 0.4025 | 0.3872 | 98 | 97 | 99 | 98 | 97 | 97 | 98 | 99 | 98 | 94 | 98 | 96 | 96 | 98 | 99 | 97 | 98 | 101 | 99 |
| | 70.00% | 30.00% | 3718 | 0.3926 | 0.3812 | 98 | 97 | 99 | 98 | 97 | 97 | 98 | 99 | 97 | 93 | 97 | 95 | 97 | 97 | 99 | 97 | 98 | 101 | 99 |
| | 60.00% | 40.00% | 3919 | 0.3831 | 0.3755 | 98 | 97 | 99 | 98 | 97 | 97 | 98 | 99 | 96 | 91 | 97 | 96 | 97 | 97 | 98 | 96 | 98 | 101 | 99 |
| | 50.00% | 50.00% | 4137 | 0.3738 | 0.3698 | 98 | 97 | 99 | 98 | 97 | 97 | 98 | 99 | 96 | 91 | 98 | 96 | 97 | 97 | 98 | 96 | 98 | 101 | 99 |
| | 40.00% | 60.00% | 4373 | 0.3648 | 0.3644 | 98 | 97 | 99 | 98 | 97 | 98 | 98 | 99 | 96 | 90 | 98 | 96 | 97 | 98 | 98 | 96 | 98 | 101 | 99 |
| | 30.00% | 70.00% | 4346 | 0.3561 | 0.3591 | 98 | 98 | 99 | 98 | 98 | 98 | 99 | 99 | 96 | 91 | 99 | 97 | 96 | 98 | 99 | 97 | 98 | 101 | 99 |
| | 20.00% | 80.00% | 4912 | 0.3476 | 0.354 | 99 | 98 | 100 | 98 | 99 | 99 | 99 | 99 | 97 | 93 | 100 | 98 | 95 | 99 | 99 | 98 | 99 | 101 | 100 |
| | 10.00% | 90.00% | 5216 | 0.3394 | 0.349 | 98 | 99 | 99 | 98 | 97 | 99 | 99 | 98 | 97 | 95 | 99 | 97 | 99 | 99 | 98 | 98 | 99 | 101 | 100 |
| | 0.00% | 100.00% | 5545 | 0.3314 | 0.3441 | 99 | 99 | 99 | 98 | 98 | 99 | 99 | 99 | 98 | 97 | 99 | 97 | 99 | 100 | 99 | 99 | 98 | 101 | 100 |

FIG. 24

| | light mixing proportion | | | | | mixed color temperature (K) | color coordinate | | CRI | | | | | | | | | | | | | | | | | TM-30-18 | | |
|---|---|---|---|---|---|---|---|---|---|---|---|---|---|---|---|---|---|---|---|---|---|---|---|---|---|---|---|---|
| | 3212K | 5545K | 570nm | 505nm | 484nm | | x | y | Ra | R1 | R2 | R3 | R4 | R5 | R6 | R7 | R8 | R9 | R10 | R11 | R12 | R13 | R14 | R15 | Rf | Rg | TLCI |
| luminous flux ratio | 100.00% | 0.00% | 0.00% | 0.00% | 0.00% | 3212 | 0.4231 | 0.3997 | 99 | 98 | 99 | 98 | 98 | 98 | 98 | 100 | 99 | 99 | 99 | 96 | 97 | 98 | 98 | 99 | 98 | 100 | 99 |
| | 84.00% | 10.00% | 2.80% | 0.80% | 0.40% | 3289 | 0.3991 | 0.3957 | 99 | 100 | 99 | 99 | 99 | 100 | 99 | 99 | 99 | 99 | 99 | 99 | 98 | 99 | 99 | 99 | 98 | 99 | 99 |
| | 72.00% | 20.00% | 4.40% | 3.30% | 0.30% | 3785 | 0.3942 | 0.3948 | 99 | 100 | 99 | 99 | 100 | 100 | 100 | 100 | 100 | 99 | 99 | 99 | 99 | 99 | 99 | 99 | 99 | 100 | 99 |
| | 62.00% | 30.00% | 4.50% | 3.20% | 0.30% | 4004 | 0.3834 | 0.3884 | 99 | 100 | 100 | 99 | 100 | 100 | 100 | 100 | 100 | 100 | 100 | 99 | 98 | 99 | 99 | 100 | 99 | 100 | 99 |
| | 53.00% | 40.00% | 4.10% | 2.60% | 0.30% | 4174 | 0.3753 | 0.3813 | 99 | 100 | 99 | 99 | 100 | 100 | 99 | 100 | 100 | 100 | 99 | 100 | 97 | 99 | 99 | 99 | 99 | 100 | 99 |
| | 44.00% | 50.00% | 3.80% | 2.90% | 0.30% | 4426 | 0.3658 | 0.3757 | 99 | 99 | 99 | 99 | 100 | 99 | 99 | 100 | 100 | 100 | 98 | 100 | 97 | 99 | 99 | 99 | 99 | 100 | 99 |
| | 33.00% | 60.00% | 3.80% | 2.70% | 0.50% | 4696 | 0.3557 | 0.369 | 99 | 100 | 99 | 100 | 98 | 99 | 99 | 99 | 99 | 99 | 99 | 99 | 96 | 99 | 100 | 99 | 98 | 99 | 99 |
| | 24.00% | 70.00% | 3.50% | 2.00% | 0.50% | 4859 | 0.35 | 0.3622 | 99 | 100 | 100 | 99 | 100 | 100 | 99 | 99 | 99 | 97 | 99 | 100 | 96 | 99 | 99 | 99 | 99 | 100 | 99 |
| | 16.00% | 80.00% | 2.20% | 1.00% | 0.80% | 5228 | 0.3411 | 0.3543 | 99 | 100 | 100 | 99 | 99 | 100 | 99 | 99 | 99 | 99 | 99 | 98 | 99 | 100 | 99 | 99 | 99 | 100 | 100 |
| | 8.00% | 90.00% | 1.10% | 0.60% | 0.30% | 5337 | 0.3348 | 0.3485 | 99 | 99 | 100 | 99 | 99 | 100 | 100 | 99 | 99 | 99 | 99 | 100 | 99 | 99 | 100 | 99 | 99 | 100 | 100 |
| | 0.00% | 100.00% | 0.00% | 0.00% | 0.00% | 5545 | 0.3314 | 0.3441 | 99 | 99 | 99 | 98 | 98 | 99 | 99 | 99 | 98 | 97 | 99 | 97 | 99 | 100 | 99 | 99 | 98 | 101 | 100 |

FIG. 25

LIGHT MIXING ADJUSTMENT METHOD, DEVICE AND SYSTEM, AND STORAGE MEDIUM

CROSS REFERENCE OF RELATED APPLICATION

This application claims priority to Chinese Patent Application No. 2019104955832, entitled "Light Mixing Adjustment Method, Device and System, and Storage Medium," filed on Jun. 5, 2019, the entire contents of which are incorporated herein by reference.

BACKGROUND OF THE PRESENT INVENTION

Field of Invention

The present invention relates to the technical field of optics and illumination, and in particular, to a light mixing adjustment method, device and system, and storage medium.

Description of Related Arts

Solid-state lighting has numerous advantages, such as solid-state lighting has excellent controllability, enabling the development of various dimming and toning methods. In addition, with the continuous development of the lighting technology, for many environments that demand high quality light, some common light mixing methods usually mix two light sources, so as to adjust the light mixing color temperature. Unfortunately, these common conventional light mixing methods only mix two light sources to obtain the mixed light, and the color coordinate points of the obtained mixed light cannot be controlled according to a preset path, which is difficult to meet the requirements of color coordinate paths of mixed light for high-quality lighting conditions.

SUMMARY OF THE PRESENT INVENTION

An object of the present application is to provide a light mixing adjustment method, device and system, and storage medium, satisfying the needs for color coordinate paths of the mixed light under high-quality lighting conditions that common light mixing adjustment methods cannot achieve.

In order to achieve at least one of the above and other objects, the present invention utilizes the following technical solutions.

A light mixing adjustment method according to embodiments of the present invention, wherein the light mixing adjustment method comprises:

acquiring at least two main control light sources and at least two auxiliary light sources; and adjusting the proportional relation of luminous flux between the at least two main control light sources and the at least two auxiliary light sources to obtain a target mixed light with a target color temperature, so that the color coordinates of the target mixed light are within the preset color coordinate range, wherein the target mixed light is obtained through mixing the at least two main control light sources and the at least two auxiliary light sources, wherein the total luminous flux of all the main control light sources is greater than the total luminous flux of all the auxiliary light sources.

According to the embodiment of the present application, at least two auxiliary light sources are added on the basis of at least two main control light sources, and the proportional relation of luminous flux between a plurality of light sources is adjusted, so that the plurality of light sources can be mixed to obtain target mixed light satisfying the demands.

Alternatively, as a possible implementation, the color coordinates of the target mixed light are within the preset color coordinate range, comprising:

arranging the color coordinates of the target mixed light on the path of the preset color coordinate or keeping the distances of the color coordinates of the target mixed light to the path of the preset color coordinate shorter than a threshold.

An embodiment of the present invention allows the obtained target mixed light to achieve the expected goal through arranging a preset color coordinate range.

Alternatively, as a possible implementation, the path of the preset color coordinate is a path marked by at least a preset higher order equation on the color coordinate system or the path of the preset color coordinate is a path marked by at least a preset higher order equation and at least a first-order equation on the color coordinate system.

According to the embodiment of the present invention, the target mixed light can achieve the expected effect more accurately and quickly through converting a preset higher order equation into the path shown in the color coordinate.

Alternatively, as a possible implementation, the preset color coordinate range is determined according to the solar spectrum variation along time in correspondence with the preset geographical position.

According to the embodiment of the present invention, the preset color coordinate range is set according to the sunlight spectrum corresponding to different geographic positions and the change of the sunlight spectrum over time, so that the obtained target mixed light can simulate the sunlight illumination of the set geographic position.

Alternatively, as a possible implementation, after the target mixed light with the target color temperature is obtained, the light mixing adjustment method further comprises:

if the spectral evaluation parameters of the target mixed light are not within a preset spectral evaluation parameter range, the proportional relation of luminous flux between a plurality of auxiliary light sources is adjusted, so that the spectral evaluation parameters of the target mixed light fall within the preset spectral evaluation parameter range.

According to the embodiment of the present invention, the proportional relation of the luminous flux between the auxiliary light sources is adjusted, so that the spectrum evaluation parameters of the target mixed light are within a preset spectrum evaluation parameter range, which ensures that the target mixed light has a high-quality optical quality parameter.

Alternatively, as a possible implementation, the spectral evaluation parameters of the target mixed light is within a preset spectral evaluation parameter range, comprising:

values of a plurality of light quality evaluation parameters of the target mixed light being greater than or equal to values of the plurality of light quality evaluation parameters of at least one of the main control light sources.

According to the embodiment of the present application, the light quality evaluation parameter of the target mixed light is limited by the light quality evaluation parameter of the main control light source(s), so that the spectrum evaluation parameter of the target mixed light may be more accurately within the preset spectrum evaluation parameter range.

Alternatively, as a possible implementation, the plurality of light quality evaluation parameters comprises color rendering index-CRIRa, color rendering index-CRIR9, color rendering index-CRIR12, light quality index-CQSQa, television lighting consistency index-TLCI, and fidelity index-Rf;

the values of multiple light quality evaluation parameters of the target mixed light are greater than or equal to the values of the multiple light quality evaluation parameters of at least one of the main control light sources, comprising:

the value of the color rendering index-CRIRa of the target mixed light being greater than or equal to at least one of the values of the color rendering index-CRIRa of the main control light sources;

the value of the color rendering index-CRIR9 of the target mixed light being greater than or equal to at least one of the values of the color rendering index-CRIR9 of the main control light sources;

the value of the color rendering index-CRIR12 of the target mixed light being greater than or equal to at least one of the values of the color rendering index-CRIR12 of the main control light sources;

the value of the light quality index-CQSQa of the target mixed light being greater than or equal to at least one of the values of the light quality index-CQSQa of the main control light sources;

the value of the television lighting consistency index-TLCI of the target mixed light being greater than or equal to at least one of the values of the television lighting consistency index-TLCI of the main control light sources;

the value of the fidelity index-Rf of the target mixed light being greater than or equal to at least one of the values of the fidelity index-Rf of the main control light sources.

According to the embodiment of the present application, the light quality evaluation parameters of the target mixed light are limited by the light to correspond quality evaluation parameters of the main control light source(s), so that the spectrum evaluation parameters of the target mixed light may be more accurately within the preset spectrum evaluation parameter range, which means that the spectrum of the obtained target mixed light meets the preset requirements.

Alternatively, as a possible implementation, the step of adjusting the proportional relation of the luminous flux between the at least two main control light sources and the at least two auxiliary light sources comprises:

adjusting the proportional relation of the luminous flux between the at least two auxiliary light sources based on a preset proportional relation of the luminous flux between the at least two main control light sources.

According to the embodiment of the present application, by presetting the proportional relation of the luminous flux between the main control light sources and adjusting the proportional relation of the auxiliary light sources, the proportional relation of the luminous flux between the plurality of main control light sources and the plurality of auxiliary light sources can be adjusted more quickly, and the target mixed light can be obtained more efficiently.

Alternatively, as a possible implementation, after the adjustment of the proportional relation of the luminous flux between the at least two auxiliary light sources, the light mixing adjustment method further comprises steps of:

if the target mixed light is not obtained when the number of times of the adjustment of the proportional relation of the luminous flux between the at least two auxiliary light sources reaches a preset number of times or the duration of the adjustment of the proportional relation of the luminous flux between the at least two auxiliary light sources reaches a preset time, fine tuning the proportional relation of the luminous flux between the at least two main control light sources and adjusting the proportional relation of the luminous flux between the at least two auxiliary light sources again based on the proportional relation of the luminous flux between the at least two main control light sources after the fine tuning, so as to obtain the target mixed light.

According to the embodiment of the present invention, if it still fails to obtain a target mixed light, after the proportional relation of the luminous flux between the auxiliary light sources has been adjusted several times, it allows the adjusting mode to be changed, to obtain the target mixed light more quickly and more efficiently.

Alternatively, as a possible implementation, the at least two main control light sources comprise: at least one white light of color temperature greater than or equal to 5000K and at least one white light of color temperature lower than or equal to 3200K, wherein the at least two auxiliary light sources comprise at least one light source with predominant wavelength within a first preset wavelength range and at least one light source with predominant wavelength within a second preset wavelength range, wherein the first preset wavelength range is [540,620] nm and the second preset wavelength range is [540,620] nm.

According to the embodiment of the invention, through setting up the parameter ranges of the main control light sources and the auxiliary light sources, the target mixed light that meets the requirements can be obtained more quickly and efficiently.

Alternatively, as a possible implementation, the total luminous flux ratio of the at least two auxiliary light sources is lower than a preset value, wherein the luminous flux ratio of the auxiliary light source is the ratio of the total luminous flux of all the auxiliary light sources and the luminous flux of the mixed light after mixing, wherein the preset value is lower than 20%.

According to the embodiment of the present invention, through setting up the total luminous flux ratio of the auxiliary light sources, it allows the proportional relation of the luminous flux between the auxiliary light sources and the main control light sources to be adjusted faster, such that the target mixed light that meets the requirements can be obtained more quickly.

Alternatively, as a possible implementation, the total luminous flux ratio of the main control light sources is greater than or equal to 80%.

Alternatively, as a possible implementation, the luminous flux of the target mixed light is within a preset luminous flux range, wherein the preset luminous flux range is determined according to the variation of the sunlight radiation power corresponding to the preset geographical position along time, wherein the radiation power is the power of adjusting the sunlight radiation power of the preset geographical position based on a predetermined ratio.

According to the embodiment of the present invention, the preset luminous flux range is set according to the sunlight radiation power of different geographic positions and the change of the sunlight radiation power over time, so that the luminous flux of the target mixed light can be within a preset luminous flux range, which ensures that the target mixed light is capable of simulating the sunlight of the set geographic position.

Alternatively, as a possible implementation, the main control light source is black-body radiation.

Alternatively, as a possible implementation, the at least two main control light sources and the at least two auxiliary light sources construct a polygonal area of at least quadrangle in the color coordinate system.

According to one embodiment, the present invention further provides a light mixing adjustment device comprising:

an acquiring module, configured for acquiring a plurality of main control light sources and a plurality of auxiliary light sources; and a light adjusting module, configured for adjusting the proportional relation of luminous flux between a plurality of the main control light sources and a plurality of the auxiliary light sources to obtain a target mixed light with a target color temperature, so that the color coordinates of the target mixed light are within the preset color coordinate range, wherein the target mixed light is obtained through mixing a plurality of the main control light sources and a plurality of the auxiliary light sources, wherein the total luminous flux of all the main control light sources is greater than the total luminous flux of all the auxiliary light sources.

According to the embodiment of the present application, at least two auxiliary light sources are added on the basis of at least two main control light sources, and the proportional relation of luminous flux between a plurality of light sources is adjusted, so that the plurality of light sources can be mixed to obtain target mixed light satisfying the demands.

According to one embodiment, the present invention further provides a light mixing adjustment system, configured for executing the above light mixing adjustment methods, wherein the light mixing adjustment system comprises:

a controller and a driver connected with the controller and the at least two main control light sources and the at least two auxiliary light sources, wherein the controller is configured for controlling the driver to output driving signals to the illuminators respectively corresponding to the at least two main control light sources and the at least two auxiliary light sources, wherein the luminous flux of each of the illuminators changes according to the corresponding driving signal received thereby.

According to the embodiment of the present invention, through providing the controller and the driver, the controller can control the driver to send a driving signal to the illuminators corresponding to the main control light sources and the auxiliary light sources, so that the plurality of light sources can achieve the target mixed light meeting the requirements.

In addition, the proportions of the main control light source and the auxiliary light source can respectively be adjusted, so that the proportions of the auxiliary light source in the target mixed light can be reduced along with the increase of the main control light source, or the proportion of the auxiliary light source in the target mixed light can be increased along with the decrease of the main control light source.

Alternatively, as a possible implementation, the controller and the driver communicate through means selected from the group consisting of wired connection, wireless connection, and a combination thereof.

According to the embodiment of the present invention, the controller and the driver are connected in a wireless or wired manner, so that the controller can control the driver more conveniently.

Alternatively, as a possible implementation, the light mixing adjustment system further comprises: a converter, connected with the driver with an end thereof and connected with the controller with another end thereof, wherein the converter is configured for converting the type of the control signal output by the controller, so as to adapt the control signal for the driver.

The embodiment of the present invention further provides a converter, which prevents the control signal sent from the controller from failing to match with the driver, rendering the driver fails to drive according to the control signal.

Embodiments of the present invention also provide a non-transitory computer readable storage medium, which stores computer instructions, wherein the computer instructions allow the computer to execute the above methods.

BRIEF DESCRIPTION OF THE DRAWINGS

FIG. 13 is a table diagram of simulated data of mixed light without adding an auxiliary light source according to an embodiment of the present invention.

FIG. 14 is a table diagram of simulated data of mixed light adding an auxiliary light source according to an embodiment of the present invention.

FIG. 24 is a table diagram of simulated data of mixed light without adding an auxiliary light source according to an embodiment of the present invention.

FIG. 25 is a table diagram of simulated data of mixed light adding an auxiliary light source according to an embodiment of the present invention.

DETAILED DESCRIPTION OF THE PREFERRED EMBODIMENT

Figure 1:
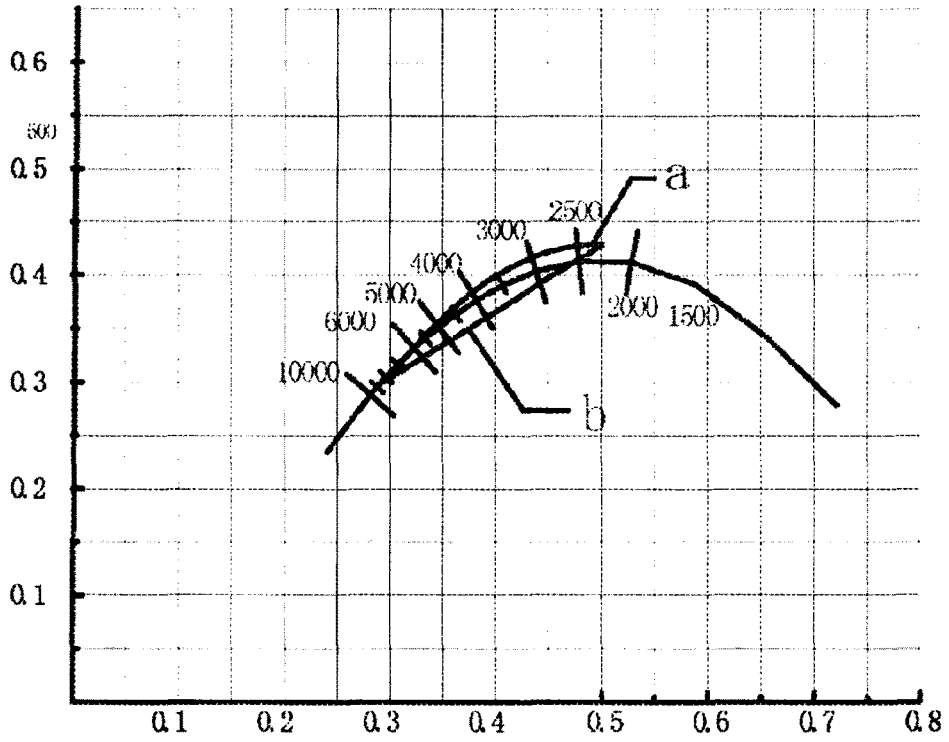
FIG. 1 is a coordinate diagram of color coordinates of a target mixed light obtained by a light mixing adjustment method utilizing two light sources.

The following describes the technical solutions of the embodiments of the present invention with reference to the appended drawings of the embodiments of the present invention.

It should be noted that similar reference numerals and letters indicate similar items in the drawings, and therefore, once a certain item is defined in one figure, it is not necessary to further define and interpret it in the subsequent figures. Meanwhile, in the description of the present invention, the terms "first," "second," and the like are utilized for distinguishing description only, and shall not be considered as indicating or implying relative importance.

In some scenarios, the color coordinate point of a mixed light with excellent light quality will be close to the color coordinate path of sunlight, and the spectrum of mixed light with excellent light quality will be close to the spectrum of sunlight as well. There are some special scenarios, which may have special requirements for the color coordinate path of the mixed light. Therefore, one of the objectives of the embodiments of the present invention is to provide a light mixing adjustment method, which can simulate the required color coordinate path, and the spectrum of the obtained mixed light is also close to a preset spectrum, so that a higher light quality index can be achieved.

In some common light mixing adjustment methods, two light sources or three light sources are generally utilized and adjusted to obtain the mixed light. FIG. 1 is a coordinate diagram of color coordinates of a target mixed light obtained by a light mixing adjustment method utilizing two light sources, wherein Path a illustrates a path of a sunlight in the color coordinate system. Path b illustrates a changeable range of a mixed light mixed of two light sources in the color coordinate system. It can be seen that when the two light sources are utilized for light mixing, the color coordinates of the mixed light can only fall on the straight line connected between the two light sources, and the difference between the obtained light mixing path and the preset color coordinate path is large.

It should be noted that color coordinate is one of the important contents of the colorimetry, and the color coordinate measurement of the light source is one of the important methods for studying the characteristics of the light source. The color coordinate measurement may be derived from the basic regulations of the color coordinates according to the spectral distribution of the light source. In a color coordinate system, internationally, the quantitative representation of color is provided with a Munsell color system, a CIE color system, and etc., and the systems can be converted under certain conditions. Accordingly, the color coordinate system may follow a CIE 1931 standard or a CIE 1976 or other system or standard. The standard of the specific color coordinate system may be selected according to actual needs.

Figure 2:
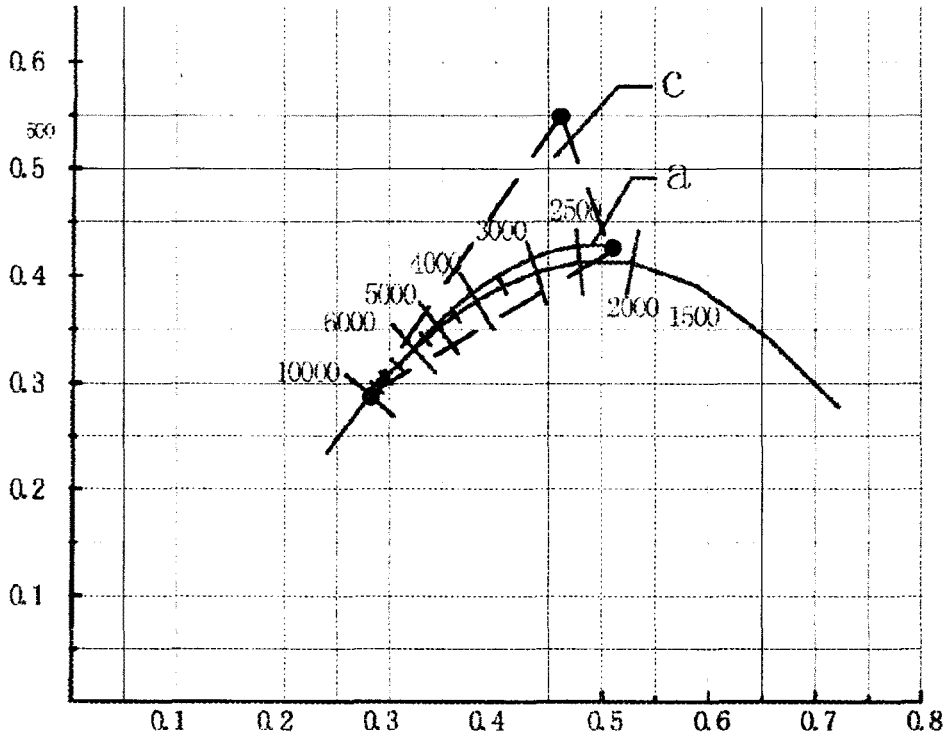
FIG. 2 is a coordinate diagram of color coordinates of a target mixed light obtained by a light mixing adjustment method utilizing three light sources.

FIG. 2 is a coordinate diagram of color coordinates of a target mixed light obtained by a light mixing adjustment method utilizing three light sources, wherein Path a illustrates a path of a sunlight in the color coordinate, while Area c illustrates a changeable range of a mixed light mixed of three light sources in the color coordinate system. It can be seen that when three light sources are utilized for light mixing, the range of the color coordinate points of the mixed light forms a "triangle" region in the color coordinate system, and the light mixing adjustable range comparing to the mixed light obtained by the light mixing adjustment method of two light sources is significantly increased, but the color coordinate of the mixed light still fails to meet the condition of the preset color coordinate path.

Figure 3:
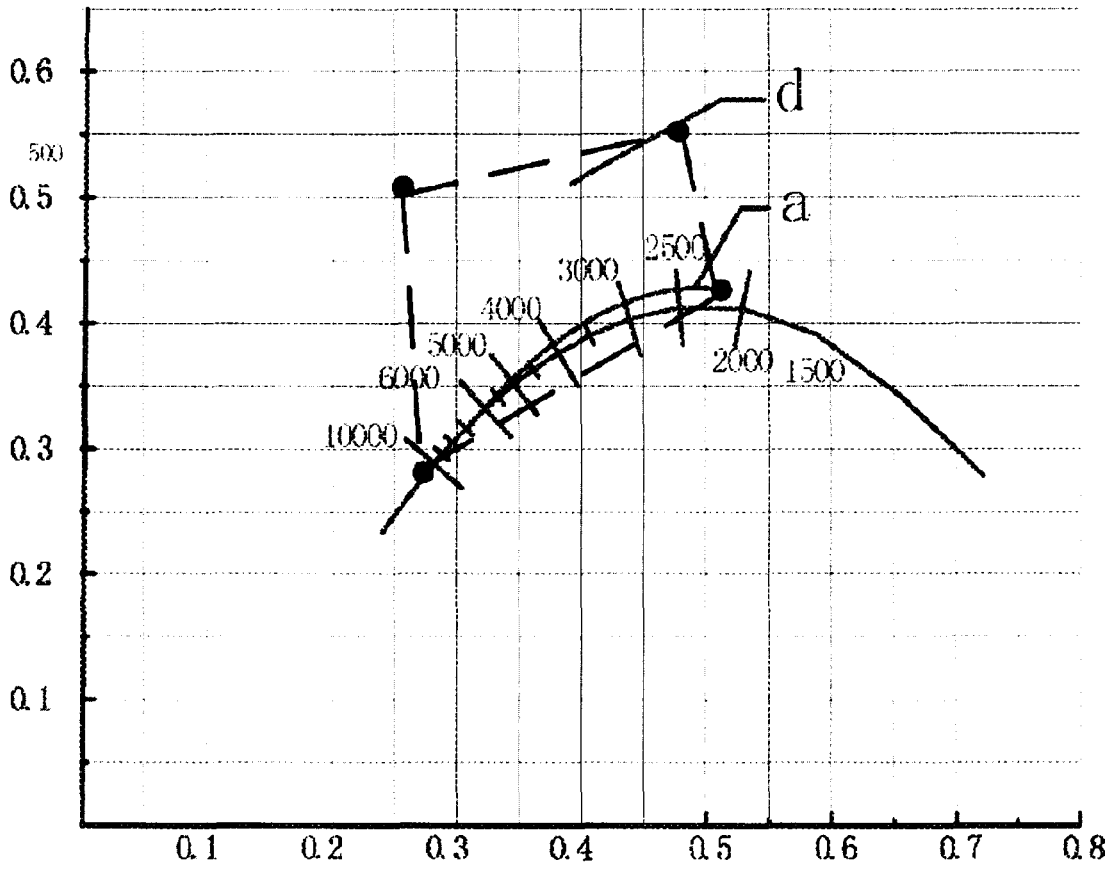
FIG. 3 is a coordinate diagram of color coordinates of a target mixed light obtained by a light mixing adjustment method according to an embodiment of the present invention.

FIG. 3 is a coordinate diagram of color coordinates of a target mixed light obtained by a light mixing adjustment method according to an embodiment of the present invention, wherein Path a illustrates a path of a sunlight in the color coordinate. Area d illustrates a changeable range of a mixed light obtained through a light mixing adjustment method according to an embodiment in the present invention. It can be seen that, when the at least two main control light sources and the at least two auxiliary light sources are utilized for light mixing adjustment, a range of color coordinate points of the obtained mixed light forms a "polygon" region of at least a quadrilateral in the color coordinate system. Compared with the area of the color coordinate points of the mixed light obtained by utilizing three light sources in the area of the color coordinate system, the range of the color coordinate points is obviously enlarged, and the obtained color coordinate of the mixed light can fall within the preset color coordinate path range.

Figure 4:
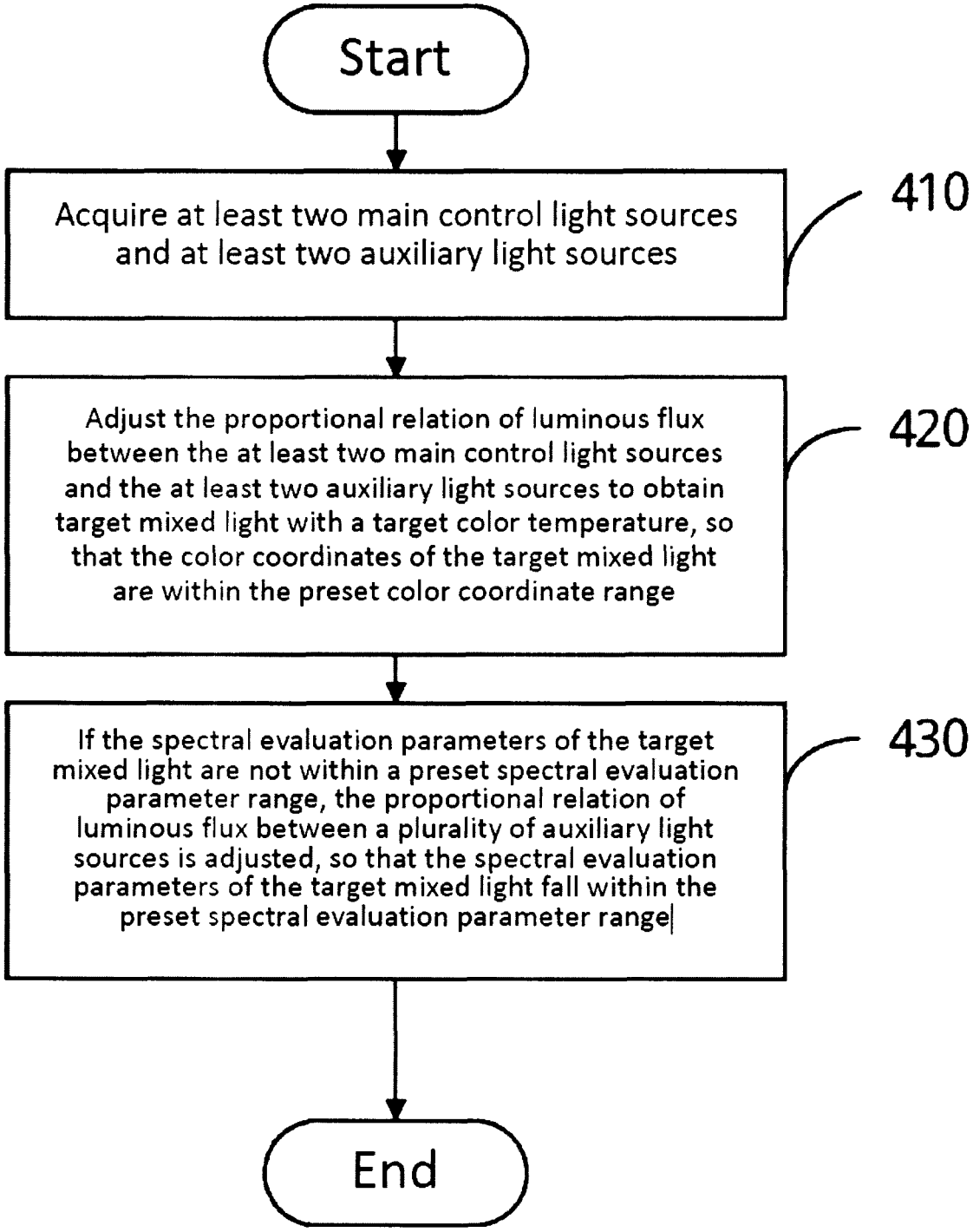
FIG. 4 is a flow chart of a light mixing adjustment method according to an embodiment of the present invention.

FIG. 4 is a flow chart of a light mixing adjustment method according to an embodiment of the present invention. An embodiment of the present invention provides a light mixing adjustment method, comprising the following steps:

Step 410: Acquire at least two main control light sources and at least two auxiliary light sources.

According to some alternative implementations, a mixed light may be obtained through acquiring and mixing at least two main control light sources and at least two auxiliary light sources. Here, the general position of the mixed light in the color coordinate system may be determined by the properties of the acquired main control light sources, and in some possible implementations, the main control light sources may be a black-body radiation, or other types of light sources. In addition, the position of the mixed light in the color coordinate system may also be adjusted according to the properties of the auxiliary light sources, wherein the auxiliary light source may be a light source having a narrower waveband, or a monochromatic light source, or may be obtained by exciting a fluorescent substance through the LED chip. The present invention can mix two light sources with different properties to obtain mixed light, and the mixed light may be black-body radiation, or may be light other than black-body radiation.

It should be noted that in black body radiation, as the temperature changes, the color of the light may also change; for example, as the temperature increases, the black body presents a gradient process of red—orange red—yellow—yellow white—white—blue white. The definition of the color temperature is derived from the temperature of the black body radiation, and the black body radiation path can be expressed in color temperature within a certain threshold range. Here, the at least two main control light sources may comprise at least one white light of color temperature greater than or equal to 5000K and at least one white light of color temperature lower than or equal to 3200K. Besides, the at least two auxiliary light sources may comprise at least one light source with predominant wavelength within a first preset wavelength range and at least one light source with predominant wavelength within a second preset wavelength range. Here, the first preset wavelength range can be [540, 620] nm, and the second preset wavelength range can be [460,540] nm. Accordingly, through presetting the parameters of the main control light sources and the auxiliary light sources, the target mixed light that meets the requirements can then be obtained more quickly and efficiently.

It should also be noted that, according to some possible implementations, the quantity of the main control light sources may be two or more, and the quantity of the auxiliary light sources is two or more, wherein the quantities of the main control light source and the auxiliary light source are not limited in the embodiments of the present invention, but may be altered according to actual requirements.

In addition, if a plurality of monochromatic light chips are utilized to serve as a plurality of auxiliary light sources, the plurality of monochromatic light chips may be disposed on the same light emitting surface to the main control light source, or the auxiliary light source and the main control light source may be disposed on different light emitting surfaces, or may be packaged together with the main control light source, or each light source may be packaged separately. If multiple auxiliary light sources are provided by using the excitation fluorescent substances, the auxiliary light sources and the main control light sources may be disposed on different light emitting surfaces, be packaged together with the main control light source, or may not be packaged together. According to some possible implementations, the light source setting method may be adjusted according to actual light mixing requirements.

Step 420: Adjust the proportional relation of luminous flux between the at least two main control light sources and the at least two auxiliary light sources to obtain target mixed light with a target color temperature, so that the color coordinates of the target mixed light are within the preset color coordinate range.

Here, the target mixed light is obtained through mixing the at least two main control light sources and the at least two auxiliary light sources, wherein the total luminous flux of all the main control light sources is greater than the total luminous flux of all the auxiliary light sources. Besides, according to some possible implementation, the at least two main control light sources and the at least two auxiliary light sources construct a polygonal area of at least quadrangle in the color coordinate system.

According to some alternative embodiments of the present invention, the proportional relation of the luminous flux between the plurality of light sources may affect the position of the mixed light in the color coordinate system. Therefore, the color temperature of the mixed light obtained by mixing the plurality of light sources can be adjusted by adjusting the proportional relation of the luminous flux between the plurality of light sources, so that the color temperature point on the color coordinate can be adjusted, so that the color coordinate of the target mixed light can be within a preset color coordinate range; in other words, the color coordinate of the target mixed light meets the preset requirements. Therefore, the target mixed light can be utilized in environments with relatively high light mixing requirements, such as museums, television stations, hospitals, and etc. Hence, according to the embodiment of the present invention, at least two auxiliary light sources are added on the basis of at least two main control light sources, and the proportional relation of luminous flux among a plurality of the light sources is adjusted, so that the plurality of light sources can be mixed in an easier and faster manner, to obtain the mixed light that satisfies the demands.

It should be noted that the proportional relation of the luminous flux of the plurality of light sources may also be adjusted by controlling the currents of the illuminators corresponding to the light sources. That is, the proportional relation of the luminous flux between the plurality of light sources is adjusted.

Here, the color coordinates of the target mixed light are within the preset color coordinate range, which may comprise: arranging the color coordinates of the target mixed light on the path of the preset color coordinate, or keeping the distances of the color coordinates of the target mixed light to the path of the preset color coordinate shorter than a threshold.

According to some optional embodiments of the present invention, by adjusting the proportional relation of the luminous flux between the main control light sources and the auxiliary light sources, the color coordinates of the target mixed light may be on a preset color coordinate path, or the distance from the preset color coordinate path is less than a threshold. Some common preset color coordinate paths have a daylight path and a black body path, and the specific color coordinate desired path of the mixed light may be adjusted according to the type of light mixing required in the actual environment. Hence, through arranging a preset color coordinate range, the obtained target mixed light is allowed to achieve the expected goal.

It has to be further pointed out that the preset color coordinate path can be a path marked by at least a preset higher order equation on the color coordinate system or the above mentioned path of the preset color coordinate can be a path marked by at least a preset higher order equation and at least a first-order equation on the color coordinate system.

Figure 5:
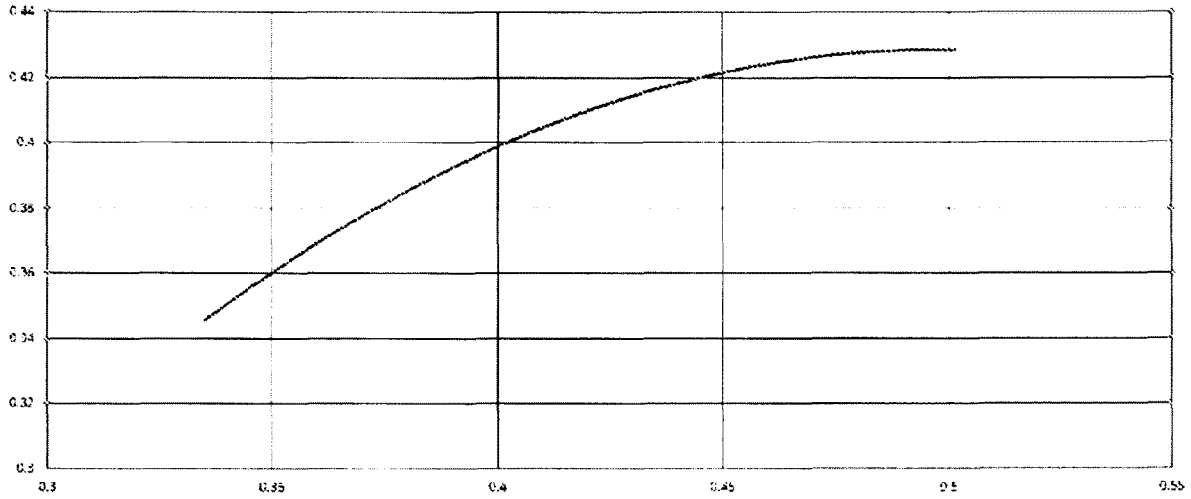
FIG. 5 is a coordinate diagram of a path of a preset color coordinate corresponding to a preset higher order equation according to an embodiment of the present invention.

According to some optional embodiments of the present invention, the preset color coordinate path may be obtained according to a path marked in the color coordinate system by a preset higher order equation. For example, as illustrated in FIG. 5, FIG. 5 illustrates of a path of a preset color coordinate corresponding to a preset higher order equation according to an embodiment of the present invention, wherein the preset higher order equation for the calculation to obtain the preset color coordinate path may be represented as follows:

$$y = 0.2072x^3 - 3.4331x^2 + 3.2598x - 0.3691$$

In the formula, x represents a horizontal coordinate of the path of the preset color coordinate, and y represents an ordinate of the path of the preset color coordinate.

In addition, the path of the preset color coordinate may also be obtained according to the path illustrated in the color coordinate system through a plurality of higher order equations. For example, the higher order equation for obtaining the corresponding path of the preset color coordinate may be represented as follows:

$$\begin{cases} n = (x - 0.3320)/(y - 01858) \\ CCT = -437n^3 + 3601n^2 - 6831n + 5517 \end{cases}$$

In the formula, x represents a horizontal coordinate of the path of the preset color coordinate, y represents an ordinate of the path of the preset color coordinate, and CCT represents color temperature.

Of course, it should be understood that the above is merely an example, and in some other possible implementations of the present invention, the path of the preset color coordinate may also be obtained by a combination of a higher order equation and a first-order equation to illustrate the path on the color coordinate system. The setting method for specific preset color coordinate path may be adjusted according to actual requirements for light mixing, which shall not limit the present invention.

According to some other alternative embodiments of the present invention, the preset color coordinate range may be determined according to the solar spectrum variation along time in correspondence with the preset geographical position. That is, the geographical position to be simulated may be selected in advance, and the corresponding sunlight spectrum may be obtained according to the geographical position, namely, the spectrum of the sunlight. According to the change of the sunlight spectrum over time, the corresponding preset color coordinate range can be determined, so that the target mixed light can more truly simulate the sunlight of the preset geographic position.

It should be noted that the plurality of geographical positions and the corresponding sunlight spectrum over time may be pre-stored, so that the corresponding sunlight spectrum may be selected according to the geographical position for reference. The type and quantity of specific geographical positions may be changed according to the requirements of the mixed light.

On the basis of the above embodiment, after the Step 420, the light mixing adjustment method may further include the following steps:

Step 430: If the spectral evaluation parameters of the target mixed light are not within a preset spectral evaluation parameter range, the proportional relation of luminous flux between a plurality of auxiliary light sources is adjusted, so that the spectral evaluation parameters of the target mixed light fall within. the preset spectral evaluation parameter range.

According to some alternative embodiments of the present invention, the spectrum of the mixed light may also be utilized as one of the evaluation indexes for the mixed light, and some common method for evaluating the spectrum of a mixed light is to refer to the spectral evaluation parameters of the mixed light, so that whether the spectrum of the mixed light meets the preset requirements can be measured more quickly. Therefore, after the color coordinate of the target mixed light falls within the preset color coordinate range, it may detect whether the spectral evaluation parameters of the target mixed light is within the preset spectrum evaluation parameter range. If not, it may have the spectral evaluation parameters of the target mixed light meet the requirements through adjusting the proportional relation of the luminous flux between the auxiliary light sources. Accordingly, the proportional relation of the luminous flux between the auxiliary light sources is adjusted, which ensures that the target mixed light has a high-quality optical quality parameter.

Here, the spectral evaluation parameters of the target mixed light are within a preset spectral evaluation parameter range, comprising: the values of a plurality of light quality evaluation parameters of the target mixed light being greater than or equal to the values of the plurality of light quality evaluation parameters of at least one of the main control light sources.

According to an optional implementation process of the present invention, the spectrum evaluation parameters include a light quality parameter, and the light quality parameter of the mixed light and the light quality parameter of the main control light source may be compared to ensure that the light quality of the mixed light is improved compared with the light quality of the main control light source. Therefore, whether the spectrum evaluation parameter of the target mixed light is within a preset spectrum evaluation parameter range may be determined more quickly.

It may be understood that, according to some possible implementations of the present invention, the plurality of light quality evaluation parameters may include a color rendering index-CRIRa, a color rendering index-CRIR9, a color rendering index-CRIR12, a light quality index-CQSQa, a television lighting consistency index-TLCI, an fidelity index-Rf, and etc.; the value of the plurality of light quality evaluation parameters of the target mixed light is greater than or equal to the value of the plurality of light quality evaluation parameters of the at least one main control light source, and may include: a value of the color rendering index-CRIRa of the target mixed light is not less than a value of the color rendering index-CRIRa of the at least one main control light source; and the value of the color rendering index-CRIR9 of the target mixed light is not less than the value of the color rendering index-CRIR9 of the at least one main control light sources; and the value of the color rendering index-CRIR12 of the target mixed light is not less than the value of the color rendering index-CRIR12 of the at least one main control light sources; the value of the light quality index-CQSQa of the target mixed light is not less than the value of the light quality index-CQSQa of the at least one main control light sources; and the value of the television lighting consistency index-TLCI of the target mixed light is not less than the numerical value of the television lighting consistency index-TLCI of the at least one main control light source; and the value of the fidelity index-Rf of the target mixed light is not less than the value of the fidelity index-Rf of the at least one main control light sources.

It should be noted that, according to some other embodiments of the present invention, the light quality evaluation parameters may further include parameters such as the color rendering index of CRI R1-R8, the color rendering index-CRIR11, and the color rendering index of CRIR14-R15. In order to obtain a high-quality target mixed light, the preset light quality parameters of the target mixed light may be set according to the spectrum evaluation parameter of the main control light source, for example, the preset light quality parameter of the target mixed light may be directly set to be:

Ra≥99, R1-R9≥98, R11-R12≥96 and R14-R15≥98, and Rf≥98, 99≥Rg≤101, TLCI≥99.

On the basis of the above embodiment, in the step 420, the adjustment of the proportional relations of the luminous flux among the at least two auxiliary light sources and the at least two main control light sources may comprise: adjusting the proportional relation of the luminous flux between the at least two auxiliary light sources based on a preset proportional relation of the luminous flux between the at least two main control light sources.

On the basis of some optional embodiments of the present invention, in order to obtain the target mixed light quickly, the proportional relation of the luminous flux between the main control light sources can be determined first according to the preset light quality range, and then the proportional relation of the luminous flux between the auxiliary light sources is adjusted. Therefore, through method of controlling the variable, the target mixed light meeting the requirements can be obtained more quickly.

The method for determining the proportional relation of the luminous flux between the main control light sources according to the preset light quality range may include, for example, obtaining a proportional relation of the luminous flux between the main control light sources according to a preset formula, determining a proportional relation of the luminous flux between the main control light sources according to the historical light mixing adjustment process, and etc.

For example, the main control light sources may comprise a light source ① and a light source ② and the auxiliary light sources may comprise a light source ③ and a light source ④. Setting the luminous flux ratio between the light source ① and the light source ② remains unchanged, and the ratio of the total luminous flux of all the main control light sources to the total luminous flux of all the main control light sources remains unchanged. The ratio of the luminous flux of the light source ③ and light source ④ is set to be 3:7, and based on the 3:7 of the ratio of the light source ③ to the light source ④, the light source ①, the light source ②, the light source ③, and the light source ④ are mixed to obtain the first target mixed light. Examine the first mixed light to obtain the color coordinate of the first target mixed light, and compare the color coordinate of the first target mixed light with the preset color coordinate range. If the color coordinates of the first target mixed light are not within the preset color coordinate range, the ratio of the luminous flux between the light source ③ and the light source ④ needs to be re-determined. The light source ①, the light source ②, the light source ③, and the light source ④ are mixed again according to the re-determined ratio of luminous flux between the light source ③ and the light source ④ until the color coordinates of the obtained target mixed light are within the pre-set color coordinate range.

On the basis of the above embodiment, after adjusting the proportional relation of the luminous flux between the at least two auxiliary light sources based on a preset proportional relation of the luminous flux between the at least two main control light sources, the light mixing adjustment method further comprises the following steps:

if the target mixed light is not obtained when the number of times of the adjustment of the proportional relation of the luminous flux between the at least two auxiliary light sources reaches a preset number of times or the duration of the adjustment of the proportional relation of the luminous flux between the at least two auxiliary light sources reaches a preset time, fine tuning the proportional relation of the luminous flux between the at least two main control light sources, and adjusting the proportional relation of the luminous flux between the at least two auxiliary light sources again based on the proportional relation of the luminous flux between the at least two main control light sources after the fine tuning, so as to obtain the target mixed light.

According to some optional embodiments of the present invention, in the light mixing adjustment process, there may be no proportional relation of the luminous flux between the main control light sources, and at this time, the mixed light meeting the requirement cannot be mixed according to the proportional relation of the luminous flux between the main control light sources. Therefore, when executing the Step 420: when the number of times of the adjustment of the proportional relation of the luminous flux between the at least two auxiliary light sources based on a preset proportional relation of the luminous flux between the at least two main control light sources reaches a number of times or the duration of repeating the step reaches a preset time, fine tuning the proportional relation of the luminous flux between the main control light sources and adjusting the proportional relation of the proportional relation between the auxiliary light sources again based on the proportional relation of the luminous flux between the at least two main control light sources after the fine tuning, so as to obtain the target mixed light.

It is worth mentioning that if the fine-tuned proportional relation of the luminous flux between the main light sources still fails to achieve a required mixed light, it may conduct repetitive fine tuning of the proportional relation of the luminous flux between the at least two main control light sources and adjust the proportional relation of the luminous flux between the at least two auxiliary light sources again based on the proportional relation of the luminous flux between the at least two main control light sources after the fine tuning, until the target mixed light is obtained. Accordingly, if it still fails to obtain a target mixed light, after the proportional relation of the luminous flux between the auxiliary light sources has been adjusted several times, it allows the adjusting mode to be changed, to obtain the target mixed light more quickly and more efficiently.

For example, the main control light sources may comprise a light source ① and a light source ② and the auxiliary light sources may comprise a light source ③ and a light source ④. According to a historical light mixing adjustment process, the ratio of the luminous flux between the light source ① and the light source ② is determined to be 4:6, and then the ratio of the luminous flux between the light source ③ and the light source ④ is repeatedly adjusted according to the ratio of the luminous flux of the light source ④ to the luminous flux of the light source ②. If the number of times of adjusting the ratio of the luminous flux of the light source ③ and the light source ④ reaches the preset 20 times, and no target mixed light is obtained, the ratio of the luminous flux between the light source ① and the light source ② will be fine-tuned to 4.5:5.5, and then based on the 4.5:5.5 of the ratio of the luminous flux of the light source ① to the luminous flux of the light source ②, the ratio of the luminous flux of the light source ③ and the light source ④ is repeatedly adjusted to obtain the target mixed light.

On the basis of any of the above embodiments, the total luminous flux ratio of the at least two auxiliary light sources is lower than a preset value, wherein the luminous flux ratio of the auxiliary light source can be the ratio of the total luminous flux of all of the auxiliary light sources and the luminous flux of the mixed light after mixing, wherein the preset value is lower than 20%, which, for example, may be 5%.

According to some optional implementations of the present invention, the luminous flux ratio may be a ratio of the luminous flux of the light source to the luminous flux of the mixed light. In addition, in the light mixing adjustment process, if the total luminous flux ratio of the auxiliary light sources is set to be less than twenty percent, the obtained mixed light has a higher light quality. Accordingly, the mixed light which meets the preset requirements and is high in quality can be obtained more quickly.

According to an optional embodiment of the present invention, the total luminous flux ratio of the main control light sources may be set to be greater than or equal to another preset value, and the obtained mixed light also has a higher optical quality, wherein the other preset value may be greater than or equal to eighty percent. Moreover, the value of the preset value may be adjusted according to the actual light mixing requirements.

On the basis of any of the above embodiments, the luminous flux of the target mixed light is within a preset luminous flux range, wherein the preset luminous flux range is determined according to the variation of the sunlight radiation power corresponding to the preset geographical position along time, wherein the radiation power is the power of adjusting the sunlight radiation power of the preset geographical position based on a predetermined ratio.

According to some alternative embodiments of the present invention, when light mixing is utilized to simulate a certain ambient light, the luminous flux of the mixed light is also one of the important parts of the simulated light. Therefore, the corresponding day optical radiation power may be obtained according to a preset geographical position, namely, the radiation power of the sunlight at the geographical position. Then, the variation range of the preset luminous flux is determined according to the variation of the sunlight radiation power that changes over time, and the luminous flux of the target mixed light is adjusted, thereby ensuring that the luminous flux of the target mixed light also meets the preset requirements, thereby ensuring that the target mixed light can simulate the sunlight of the set geographic position.

It should be noted that the plurality of geographical positions and the corresponding sunlight radiation power over time may be pre-stored, so that the corresponding sunlight radiation power may be selected according to the geographical position for reference. The type and quantity of specific geographical positions may be changed according to the requirements of the mixed light.

Figure 6:
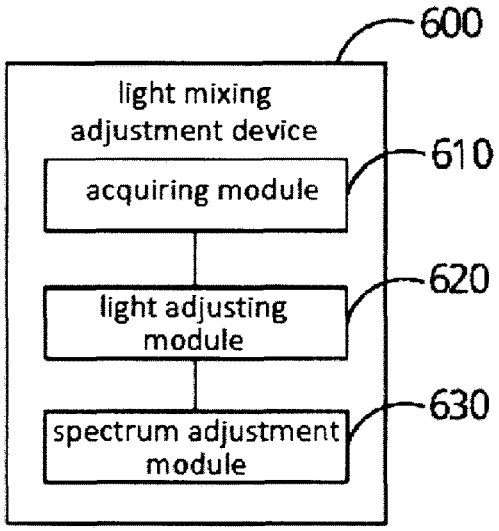
FIG. 6 is a structural schematic view of a light mixing adjustment device according to an embodiment of the present invention.

FIG. 6 is a structural schematic view of a light mixing adjustment device according to an embodiment of the present invention. The embodiment of the present invention further provides a light mixing adjustment device 600, which comprises: an acquiring module 610, configured for acquiring a plurality of main control light sources and a plurality of auxiliary light sources; and a light adjusting module 620, configured for adjusting the proportional relation of luminous flux between a plurality of the main control light sources and a plurality of the auxiliary light sources so as to obtain target mixed light with a target color temperature so that the color coordinates of the target mixed light are within the preset color coordinate range. Here, the target mixed light is obtained by mixing a plurality of the main control light sources and a plurality of the auxiliary light sources. Besides, the total luminous flux of all the main control light sources is greater than the total luminous flux of all the auxiliary light sources.

On the basis of the above embodiment, the color coordinates of the target mixed light are within the preset color coordinate range, comprise: arranging the color coordinates of the target mixed light on the path of the preset color coordinate, or keeping the distances of the color coordinates of the target mixed light to the path of the preset color coordinate shorter than a threshold.

On the basis of the above embodiment, the path of the preset color coordinate is a path marked by at least a preset higher order equation on the color coordinate system or the preset color coordinate path is a path marked by at least a preset higher order equation and at least a first-order equation on the color coordinate system.

On the basis of the above embodiment, the preset color coordinate range is determined according to the solar spectrum variation along time in correspondence with the preset geographical position.

On the basis of the above embodiment, the light mixing adjustment device 600 also comprises: a spectrum adjustment module 630 that if the spectral evaluation parameters of the target mixed light are not within a preset spectral evaluation parameter range, the proportional relation of luminous flux between a plurality of auxiliary light sources is adjusted, so that the spectral evaluation parameters of the target mixed light fall within. the preset spectral evaluation parameter range.

On the basis of the above embodiment, the spectral evaluation parameters of the target mixed light are within a preset spectral evaluation parameter range, comprising: the values of a plurality of light quality evaluation parameters of the target mixed light are greater than or equal to the values of the plurality of light quality evaluation parameters of at least one of the main control light sources.

On the basis of the above embodiment, the plurality of light quality evaluation parameters may include a color rendering index-CRIRa, a color rendering index-CRIR9, a color rendering index-CRIR12, a light quality index-CQSQa, a television lighting consistency index-TLCI, an fidelity index-Rf, and etc. Values of the plurality of light quality evaluation parameters of the target mixed light are greater than or equal to values of the plurality of light quality evaluation parameters of the at least one main control light source, including: a value of the color rendering index-CRIRa of the target mixed light being not less than a value of the color rendering index-CRIRa of the at least one main control light source; and the value of the color rendering index-CRIR9 of the target mixed light being not less than the value of the color rendering index-CRIR9 of the at least one main control light sources; and the value of the color rendering index-CRIR12 of the target mixed light being not less than the value of the color rendering index-CRIR12 of the at least one main control light sources; the value of the light quality index-CQSQa of the target mixed light being not less than the value of the light quality index-CQSQa of the at least one main control light sources; and the value of the television lighting consistency index-TLCI of the target mixed light being not less than the numerical value of the television lighting consistency index-TLCI of the at least one main control light source; and the value of the fidelity index-Rf of the target mixed light being not less than the value of the fidelity index-Rf of the at least one main control light sources.

On the basis of the above embodiment, the light adjusting module 620 is specifically configured for adjusting the proportional relation of the luminous flux between the at least two auxiliary light sources based on a preset proportional relation of the luminous flux between the at least two main control light sources.

On the basis of the above embodiment, the light mixing adjustment device 600 also comprises: a repetitive adjustment module, configured for: if the target mixed light is not obtained when the number of times of the adjustment of the proportional relation of the luminous flux between the at least two auxiliary light sources reaches a preset number of times or the duration of the adjustment of the proportional relation of the luminous flux between the at least two auxiliary light sources reaches a preset time, fine tuning the proportional relation of the luminous flux between the at least two main control light sources, and adjusting the proportional relation of the luminous flux between the at least two auxiliary light sources again based on the proportional relation of the luminous flux between the at least two main control light sources after the fine tuning, so as to obtain the target mixed light.

On the basis of any of the above embodiments, the at least two main control light sources comprise: at least one white light of color temperature greater than or equal to 5000K and at least one white light of color temperature lower than or equal to 3200K, wherein the at least two auxiliary light sources comprise at least one light source with predominant wavelength within a first preset wavelength range and at least one light source with predominant wavelength within a second preset wavelength range, wherein the first preset wavelength range is [540,620] nm and the second preset wavelength range is [540,620] nm.

On the basis of any of the above embodiments, the total luminous flux ratio of the at least two auxiliary light sources is lower than a preset value, wherein the luminous flux of the auxiliary light source is the ratio of the total luminous flux of all of the auxiliary light sources and the luminous flux of the mixed light after mixing, wherein the preset value is lower than 20%.

On the basis of any of the above embodiments, the luminous flux of the target mixed light is within a preset luminous flux range, wherein the preset luminous flux range is determined according to the variation of the sunlight radiation power corresponding to the preset geographical position along time, wherein the radiation power is the sunlight radiation power of the preset geographical position.

The light mixing adjustment device 600 provided by the embodiments of the present invention are configured to perform the above-mentioned light mixing adjustment method, and the specific implementation manners thereof are consistent with the implementation manners of the method, which details will not be repeated herein.

Figure 7:
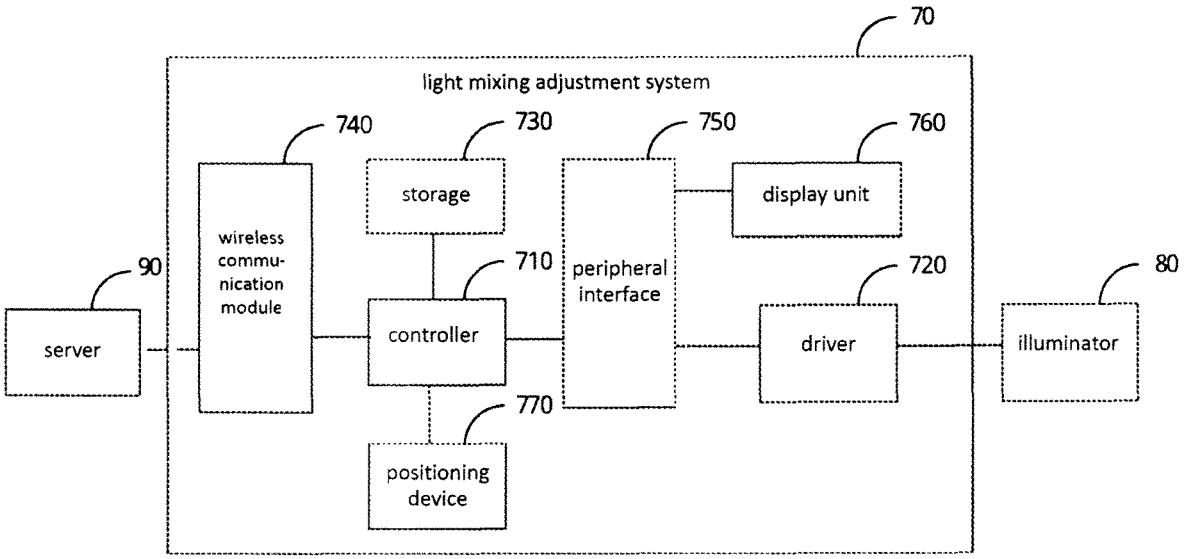
FIG. 7 is a structural schematic view of a light mixing adjustment system according to an embodiment of the present invention.

FIG. 7 is a structural schematic view of a light mixing adjustment system according to an embodiment of the present invention. The embodiment of the present invention also provides a light mixing adjustment system 70, configured for executing the above light mixing adjustment methods, wherein the light mixing adjustment system 70 comprises: a controller 710 and a driver 720 connected with the controller 710 and the at least two main control light sources and the at least two auxiliary light sources, wherein the controller 710 is configured for controlling the driver 720 to output driving signals to the illuminators 80 respectively corresponding to the at least two main control light sources and the at least two auxiliary light sources. Here, the luminous flux of each of the illuminators 80 changes according to the corresponding driving signal received thereby.

According to some alternative embodiments of the present invention, by setting the controller 710 and the driver 720, in the light mixing adjustment process, the controller 710 sends a control signal to the driver 720, so that the driver 720 sends driving signals to the illuminators 80 respectively corresponding to the main control light sources and the auxiliary light sources according to the control signal, so that the illuminators 80 can emit light according to the driving signals respectively, so as to mix light and obtain the target mixed light.

Here, the controller 710 may be an integrated circuit chip having a signal processing capability. The controller 710 may be a general-purpose processor, including a central processing unit (CPU), a network processor (NP), a digital signal processor (DSP), an application-specific integrated circuit (ASIC), a field programmable gate array (FPGA), or another programmable logic device, a discrete gate or transistor logic device, a discrete hardware component, and etc. The methods, steps, and logical block diagrams disclosed in the embodiments of the present invention can be implemented or performed. The general-purpose processor may be a microprocessor, or the controller 710 may be any conventional processor and etc.

According to an embodiment provided in the present invention, a storage 730 connected with the controller 710 may also be provided, the storage 730 stores a plurality of preset geographical positions and corresponding preset color coordinate ranges, corresponding preset spectrum evaluation parameters, and corresponding preset luminous flux ranges. In the process of light mixing adjustment, the controller 710 may obtain a proportional relation of the luminous flux between the main control light sources and the auxiliary light sources corresponding to the target light by selecting a geographical position from the storage 730, and then issue a control instruction according to the above mentioned parameters to obtain the target mixed light meeting the requirements.

It should be noted that each geographical position may correspond to a plurality of target mixed light; that is, each geographic location corresponds to a plurality of tables and each table represents a preset target mixed light, wherein a proportional relation of the luminous flux between the main control light sources and the auxiliary light sources may be queried according to each of the tables and the corresponding date.

According to another embodiment provided by the present invention, the storage 730 stores a plurality of preset geographical positions and corresponding solar spectrum over time, and corresponding light quality evaluation parameters and corresponding sunlight radiation power over time. The controller 710 may obtain, by selecting a geographical position from the memory 730, a corresponding sunlight spectrum over time, a corresponding light quality evaluation parameter and a corresponding sunlight radiation power over time, and then calculate to obtain a preset color coordinate range, a preset spectrum evaluation parameter, and a preset luminous flux range that are corresponding to the preset target light, so as to obtain a control instruction to control the plurality of light sources to mix to obtain the target mixed light meeting the requirements.

It should be noted that the controller 710 may also select a corresponding preset color coordinate range, a corresponding preset spectrum evaluation parameter, and a corresponding preset luminous flux range according to the time, so that the target mixed light may simulate the sunlight corresponding to the preset geographical position and the preset time.

The memory 730 may be, but is not limited to, a random access memory (RAM), a read-only memory (ROM), a programmable read-only memory (PROM), an erasable programmable read-only memory (EPROM), an electric erasable programmable read-only memory (EEPROM), and etc. The memory 730 is configured to store programs, and after receiving the execution instruction, the controller 710 executes the program, and the process steps disclosed in any of the above embodiments of the present invention may be executed by the defined server and applied to the controller 710 of the server, or implemented by the controller 710.

It should be noted that the light mixing adjustment system 70 may also comprise a positioning device 770 connected with the controller 710, and the controller 710 may acquire the current geographical position by means of the positioning device 770 and then interact with the server through the wireless communication module to obtain a proportional relation between the luminous flux between the corresponding main control light sources and the auxiliary light sources in the current geographical position, and then drive the main control light sources and the auxiliary light sources to achieve the target mixed light.

According to an embodiment of the present invention, the light mixing adjustment system 70 may also have a wireless communication module 740 connected with the controller 710, and the controller 710 may be connected with the server 90 or the terminal through a wireless connection to obtain a plurality of geographical positions and corresponding preset color coordinate ranges, a corresponding preset spectrum evaluation parameter and a corresponding preset luminous flux range, and may also obtain a corresponding time, thereby achieving the update of each preset parameter corresponding to the target mixed light. The server 90 may be a network server, a database server, and etc. The terminal may be a personal computer (PC), a tablet computer, a smartphone, a personal digital assistant (PDA), a wearable device, and etc.

According to another embodiment of the present invention, the light mixing adjustment system 70 further includes a peripheral interface 750, wherein the peripheral interface 750 is connected with the controller 710, and according to some embodiments, the peripheral interface 750, the controller 710, and the memory 730 may be implemented in a single chip. In other examples, they may be implemented by means of separate chips respectively. The peripheral interface 750 may be connected with the server 90, the terminal, or the removable storage device in a wired connection manner for updating each preset parameter corresponding to the target mixed light. The peripheral interface 750 may be an I/O interface, an HMI interface, or a USB interface, and the type of the specific peripheral interface 750 may vary according to the needs.

Meanwhile, the light mixing adjustment system 70 can also include a sensor connected with the peripheral interface, wherein the controller 710 communicates with the sensor through the peripheral interface 750, and the controller 710 may acquire the illumination condition in the current environment through the sensor, and adjust the proportional relation between the main control light sources and the auxiliary light sources according to the illumination condition in the current environment. The illumination condition can be utilized as an adjustment reference for the target mixed light, and therefore, the illumination condition may include an ambient light intensity, an ambient light spectrum, and etc. Correspondingly, the sensor may be provided with an illumination intensity sensor, a spectrum sensor, and etc. For example, in a rainy environment, the controller 710 adjusts the proportional relation of luminous flux between the main control light sources and the auxiliary light sources to output the target light source if the illumination intensity of the ambient light detected by the illumination intensity sensor does not reach the preset requirements.

In addition, the light mixing adjustment system 70 can also include a display unit 760, and the controller 710 can be connected with the display unit 760 through the wireless communication module 740, or can be connected with the display unit 760 in a wired connection manner. The display unit 760 is configured to provide an interactive interface (e.g., a user operation interface) between the light mixing adjustment system 70 and the user or configured to display image data to the user reference. In an embodiment, the display unit 760 can be a liquid crystal display or a touch display. If the touch display is a touch display, it can be a capacitive touch screen or a resistive touch screen supporting a single point and a multi-touch operation. Supporting a single point and a multi-point touch operation refers to a touch display being able to sense a touch operation generated at the same time from one or more locations on the touch display, and cross the sensed touch operation by the controller 710 for calculation and processing.

It should also be noted that the driver 720 can receive a control signal sent by the controller 710, for example, receiving a PWM signal, a resistance signal or a voltage signal, wherein the resistance signal may be a signal of 0-100 kΩ, and the voltage signal can also be a signal of 0-10 V. The driver 720 can also emit a corresponding driving signal according to the control signal to drive the corresponding illuminators 80, wherein the driving signal can be a signal output by a constant current, and the magnitude of the current can be adjusted according to the control signal. Thus, the luminous flux of the illuminators 80 connected with the driver 720 can be changed according to the driving signal, and the illuminants emitted by the illuminators 80 have no strobe, and the obtained mixed light also has a higher light quality.

It may be understood that the driver 720 can be integrated with the controller 710, or can be arranged separately from the controller 720. The driver 710 can be configured to emit a driving signal, so that the illuminators 80 corresponding to the main control light sources and the auxiliary light sources may generate illuminants according to the driving signal, wherein the driver may be a processor, such as an integrated MCU, a CPU, and etc.

Here, the controller 710 can also be connected with multiple drivers. In the process of light mixing adjustment, the controller 710 sends a corresponding control signal to each driver 720, so that each driver 720 drives the corresponding controller 710. Besides, the controller 710 can be connected with one driver 720 and the driver 720 is then connected with multiple illuminators 80. In the process of light mixing adjustment, the controller 710 sends a control signal to the corresponding driver 720, and the driver 720 sends corresponding drive signals respectively to the plurality of illuminators 80 according to the control signal.

Figure 8:
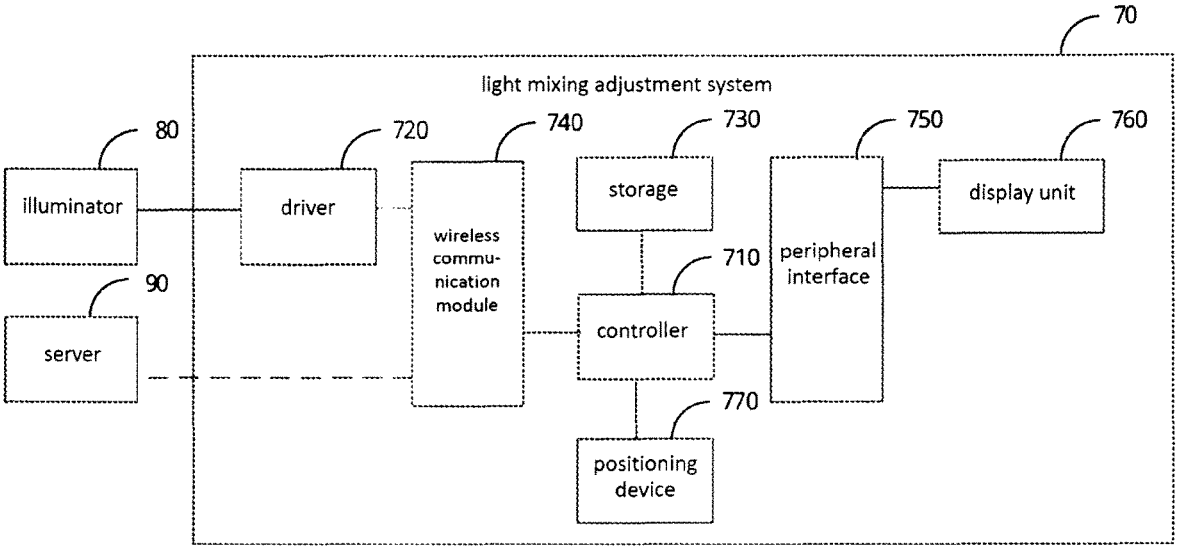
FIG. 8 is a structural schematic view of another light mixing adjustment system according to an embodiment of the present invention.

FIG. 8 is a structural schematic view of another light mixing adjustment system according to one embodiment of the present invention. As illustrated in FIG. 8, the controller 710 and the driver 720 communicate through means from the group consisting of wired connection and/or wireless connection.

In some alternative implementations of the present invention, the controller 710 and the driver 720 can communicate in a wired and/or wireless manner in view of remote control. Therefore, the controller 710 may send a control signal to the driver 720 in a wireless manner at a position farther from the driver 720 and the illuminators 80, so that the driver 720 can drive the illuminators 80 to perform the light mixing adjustment to obtain the mixed light conforming to the preset requirement.

It should also be noted that the driver 720 and the illuminators 80 can communicate in a wired and/or wireless manner, so that the driver 720 can drive the illuminators 80 remotely.

Based on the above embodiment, the light mixing adjustment system may further comprises: a converter connected with the driver 720 with an end thereof and connected with the controller 710 with another end thereof, wherein the converter is configured for converting the type of the control signal output by the controller 710, so as to adapt the control signal for the driver 720.

According to some optional implementations of the present invention, during the process of light mixing adjustment, there can be a condition that the control signal sent by the controller 710 cannot be matched with the driver 720. Therefore, the type of the secondary control signal can be converted through the converter to the type of the signal that the driver 720 can receive. For example, the PWM signal can also be converted to a 0-100 kΩ signal and a 0-10V voltage signal, or the conversion of the signal may be conducted through replacing a switching card inside the control converter. The specific signal conversion manner can be selected according to the actual model of the driver 720.

For example, it is assumed that in the light mixing adjustment system 70, the driver 720 is respectively connected with the illuminators 80 corresponding to the two main control light sources and the two auxiliary light sources. The controller 710 can receive, through the display unit 760, a geographical position selected by the user from a preset plurality of geographical positions, and obtain, through the wireless communication module 740, a time corresponding to the geographical position. Querying a table pre-stored in the memory 730 according to the time and the geographical position, to obtain a proportional relation of the luminous flux between the at least two corresponding main control light sources and the at least two auxiliary light sources. The controller 710 sends a corresponding PWM wave to the driver 720 according to the proportional relation between the corresponding luminous flux, so that the driver 720 drives the illuminators 80 of the main control light sources and the auxiliary light sources to adjust the luminous flux between the two main control light sources and the two auxiliary light sources according to the PWM output four-way constant current signal, so that the two main control light sources and the two auxiliary light sources are mixed to obtain the target mixed light with the target color temperature. The color coordinate of the target mixed light is within a preset color coordinate range, and at the same time, the value of the spectral evaluation parameters of the target mixed light is greater than or equal to the value of the preset spectral evaluation parameters, and the luminous flux range of the target mixed light is within a preset luminous flux range.

Meanwhile, the controller 710 may query, according to the time parameter, a corresponding preset color coordinate range, a corresponding preset spectrum evaluation parameter, and a corresponding preset luminous flux range related to the time in the memory 730. The target mixed light can be adjusted thereby, so that the target mixed light may simulate sunlight illumination corresponding to a preset geographic location. Here, the target mixed light can further simulate the illumination of sunlight between sunrise and sunset within a preset period. The duration of the preset period may be a period duration of sunrise; or may be set as a fixed duration, such as 8 hours, 12 hours, and etc. The duration of the specific preset period may be adjusted according to needs.

It should be noted that the power of the illuminators 80 corresponding to the main control light sources and the auxiliary light sources can also be set according to the light mixing requirement. For example, the illuminators 80 corresponding to the main control light sources may be 500 W and 1000 W, and the illuminators 80 corresponding to the auxiliary light sources may be 70 W and 100 W.

According to an embodiment of the present invention, it provides a test data for a light mixing adjustment, wherein the main control light sources can include a first light source with a color temperature of 5625K and a second light source with a color temperature of 2678K, and the auxiliary light sources can include a third light source with a wavelength of 570 nm, a fourth light source with a wavelength of 505 nm, and a fifth light source with a wavelength of 484 nm. The preset color coordinate range can also be set as: when the relevant color temperature of the target mixed light is greater than or equal to 5000K, the corresponding color coordinate point of the target mixed light is in the sun path range; when the relevant color temperature of the target mixed light is greater than 4000K and less than 5000K, the corresponding color coordinate point of the target mixed light is in a path range corresponding to the TM-30 standard; and when the relevant color temperature of the target mixed light is lower than or equal to 4000K, the color coordinate point of the corresponding target mixed light is in the black body path range. Besides, it is configured in the preset spectral evaluation parameters that Ra≥97, R1~R9≥97; R11~R12≥93; R14~R15≥97; Rf≥97, 99≤Rg≤101, TLCI≥99.

Figure 9:
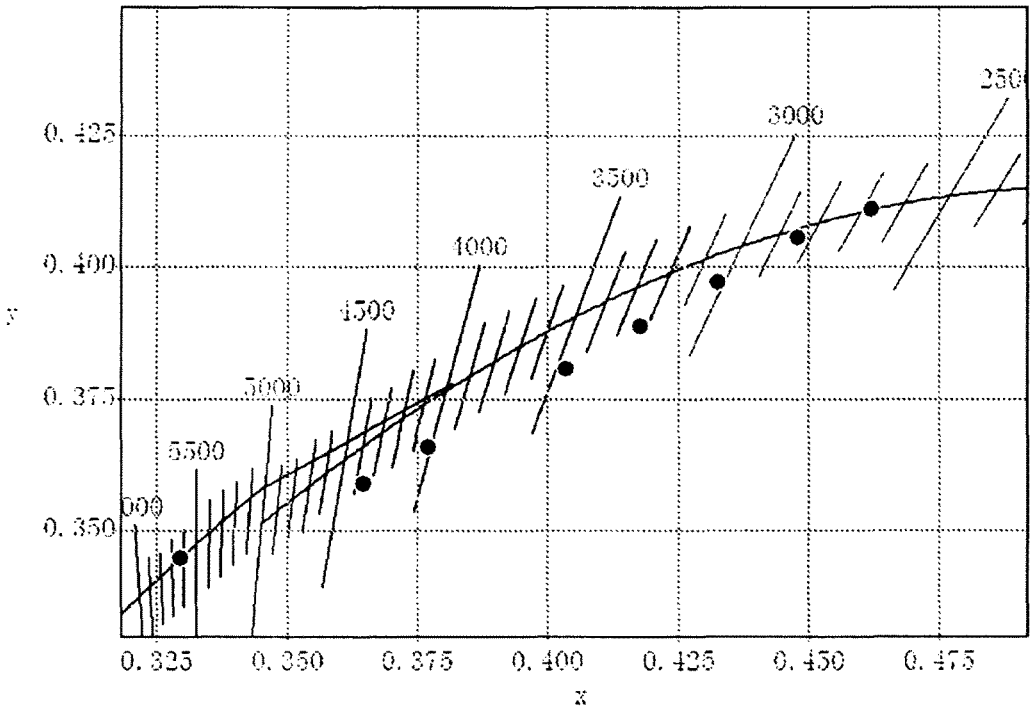
FIG. 9 is a coordinate diagram of points of mixed light color coordinates of without adding an auxiliary light source according to an embodiment of the present invention.
Figure 10:
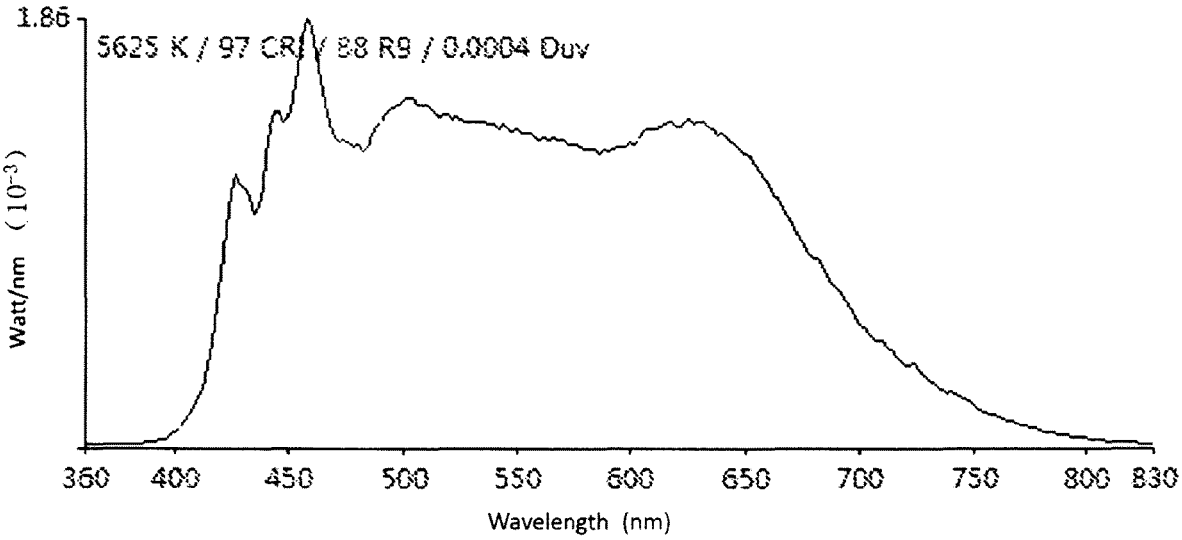
FIG. 10 is a spectrogram of a mixed light without adding an auxiliary light source according to an embodiment of the present invention.

FIG. 9 is a coordinate diagram illustrating points of mixed light color coordinates of without adding an auxiliary light source according to an embodiment of the present invention. FIG. 10 is a spectrogram illustrating a mixed light without adding an auxiliary light source according to an embodiment of the present invention. As illustrated in FIG. 8, if the mixed light is obtained only through mixing the first light source and the second light source, the color coordinates points are relatively stray and disordering, which indicates poor light mixing result and the light quality of the mixed light cannot satisfy the needs of some specific scenarios. FIG. 10 illustrates a mixed light spectrum that the luminous flux ratio of the first light source is 90%, the luminous flux ratio of the second light source is 10%, and the luminous flux ratios of the third light source, the fourth light source, and the fifth light source are all 0%.

Figure 11:
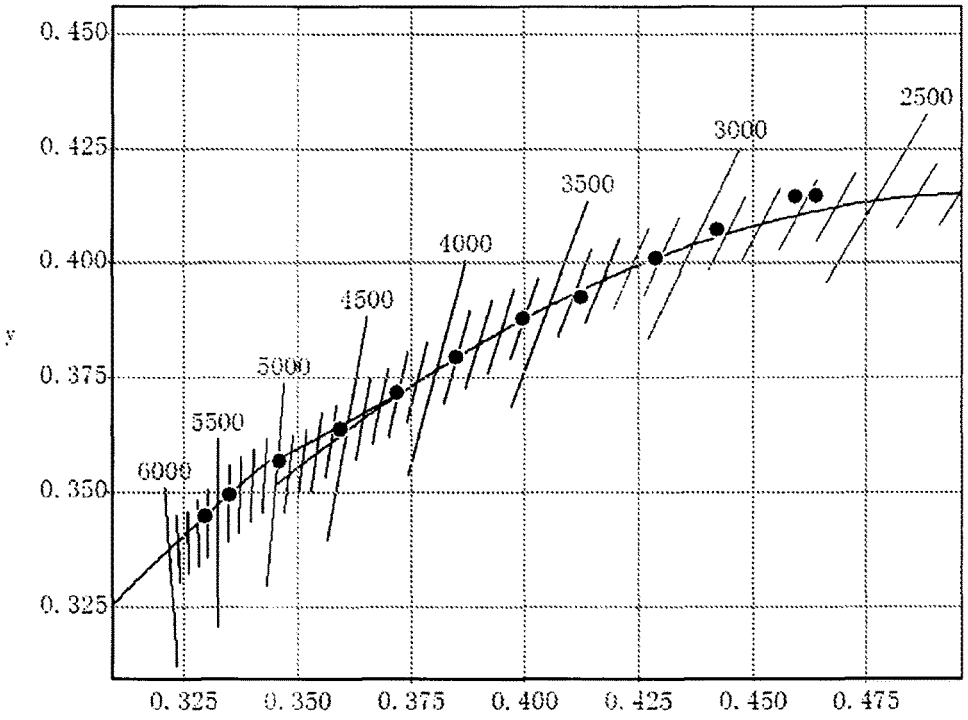
FIG. 11 is a coordinate diagram of points of mixed light color coordinates with an auxiliary light source added according to an embodiment of the present invention.
Figure 12:
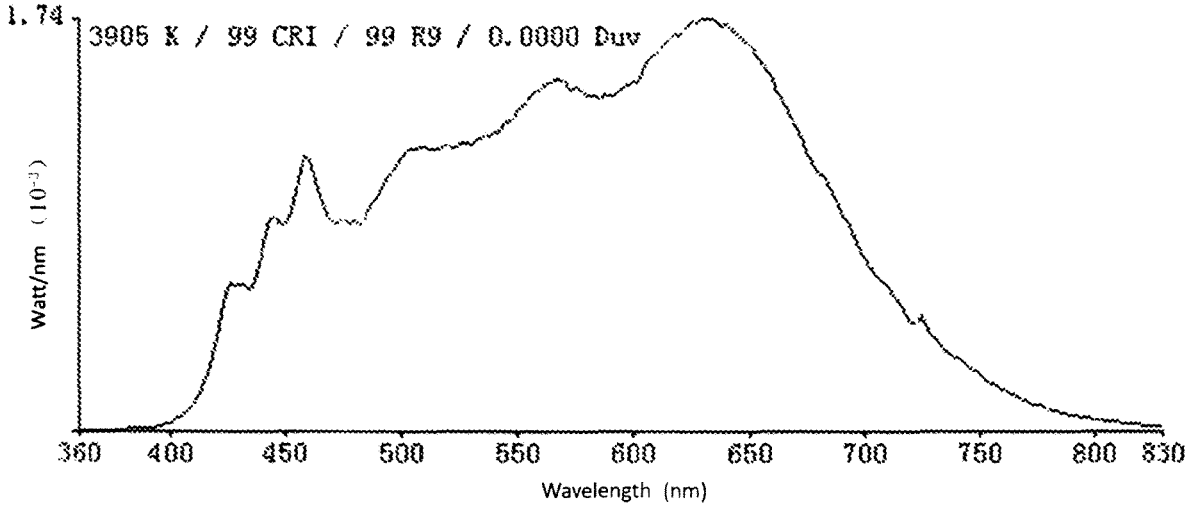
FIG. 12 is a spectrogram of a mixed light with an auxiliary light source added according to an embodiment of the present invention.

FIG. 11 is a coordinate diagram illustrating points of mixed light color coordinates with an auxiliary light source added according to an embodiment of the present invention. FIG. 12 is a spectrogram illustrating a mixed light with an auxiliary light source added according to an embodiment of the present invention. As illustrated in FIG. 11, the first light source, the second light source, the third light source, the fourth light source, and the fifth light source are mixed to obtain the mixed light, wherein the color coordinate point of the obtained mixed light is within a preset color coordinate range, the light mixing result is good, the light quality of the mixed light is good, and the preset requirement can be met. FIG. 12 illustrates a mixed light spectrum that the luminous flux ratio of the first light source is 50%, the luminous flux ratio of the second light source is 43%, the luminous flux ratio of the third light source is 5.7%, the luminous flux ratio of the fourth light source is 1.3%, and the luminous flux ratio of the fifth light source is 0%.

FIG. 13 is a table diagram illustrating simulated data of mixed light without adding an auxiliary light source according to an embodiment of the present invention. FIG. 14 is a table diagram of simulated data of mixed light adding an auxiliary light source according to an embodiment of the present invention. Meanwhile, since the spectrum is relatively complex, the spectrum of the mixed light can be evaluated with reference to FIG. 13 and FIG. 14. It can be found that based on the main control light source, the auxiliary light source is added, and the proportional relationship between the luminous flux between the multiple light sources is adjusted, so that the obtained spectrum evaluation parameters of the target mixed light can be greatly improved. For example, the color rendering index-CRIRa, color rendering index-CRIR9, color rendering index-CRIR12, light quality index-CQSQa, television lighting consistency index-TLCI, and fidelity index-Rf are all greatly improved, and are close to the spectrum evaluation parameters of the main control light source.

According to another implementation of the present invention, it further provides another test data for another light mixing adjustment, wherein the main control light sources may include a first light source with a color temperature of 5545K and a second light source with a color temperature of 3212K, and the auxiliary light sources may include a third light source with a wavelength of 570 nm, a fourth light source with a wavelength of 505 nm, and a fifth light source with a wavelength of 484 nm. The preset color coordinate range is also set as: the color coordinate path of the target mixed light is similar to the color coordinate path corresponding to the sun, the spectrum of the target mixed light is similar to the spectrum corresponding to the sun, and the color rendering index range of the target mixed light is Ra≥99, R1·R9≥98, R11~R12≥96 and R14~R15≥98, besides Rf≥98, 99≤Rg≤101, TLCI≥99.

Figure 15:
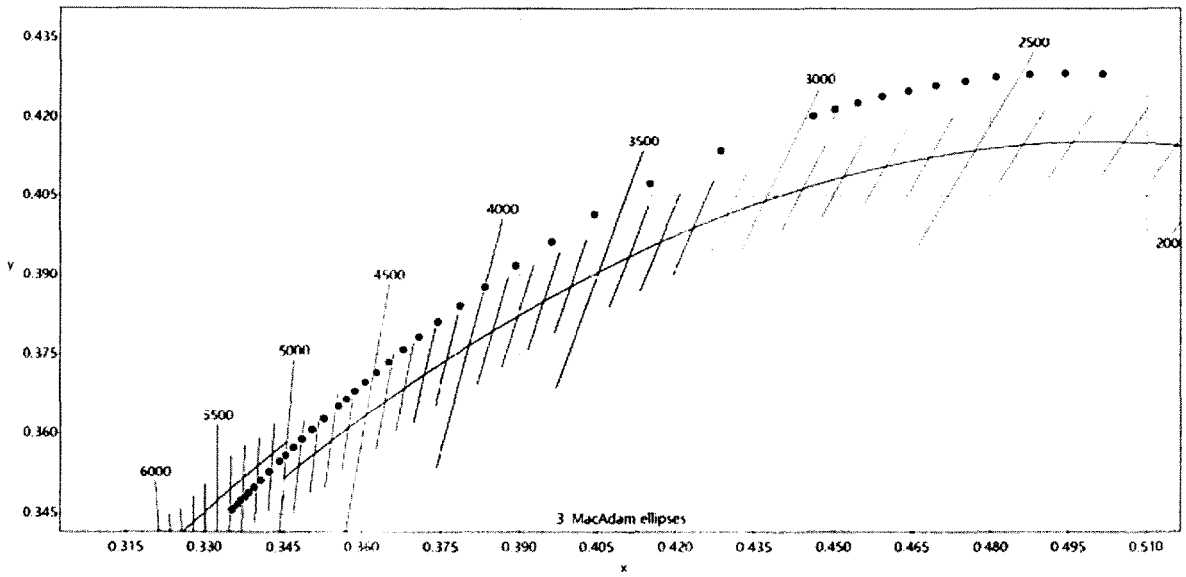
FIG. 15 is a coordinate diagram of real color coordinate path of sunlight corresponding to a preset geographical position according to an embodiment of the present invention.
Figure 16:
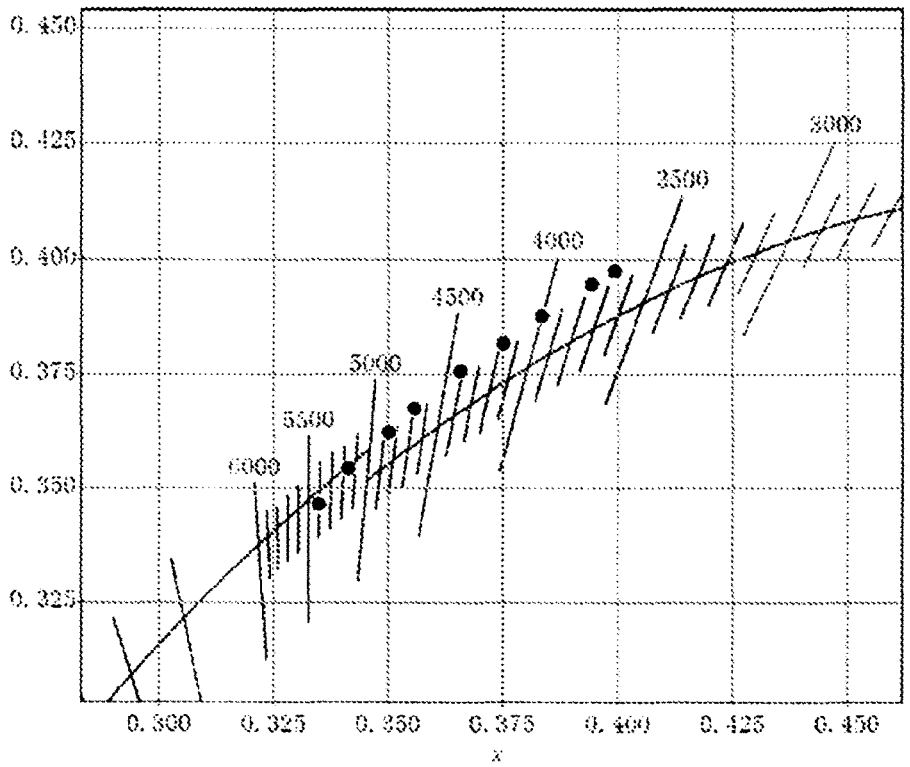
FIG. 16 is a coordinate diagram of points of mixed light color coordinates with an auxiliary light source added according to an embodiment of the present invention.

FIG. 15 is a coordinate diagram illustrating a real color coordinate path of sunlight corresponding to a preset geographical position according to an embodiment of the present invention. Here, the range of the preset color coordinate may be the real color coordinate path of sunlight, as illustrated in FIG. 15. FIG. 16 is a coordinate diagram of points of mixed light color coordinates with an auxiliary light source added according to an embodiment of the present invention. It can be seen from FIG. 16 that when light mixing is performed through the light mixing adjustment method, the color coordinate points of the obtained mixed light are distributed within a preset color coordinate range, and the color coordinate path is also close to the real path of sunlight.

Figure 17:
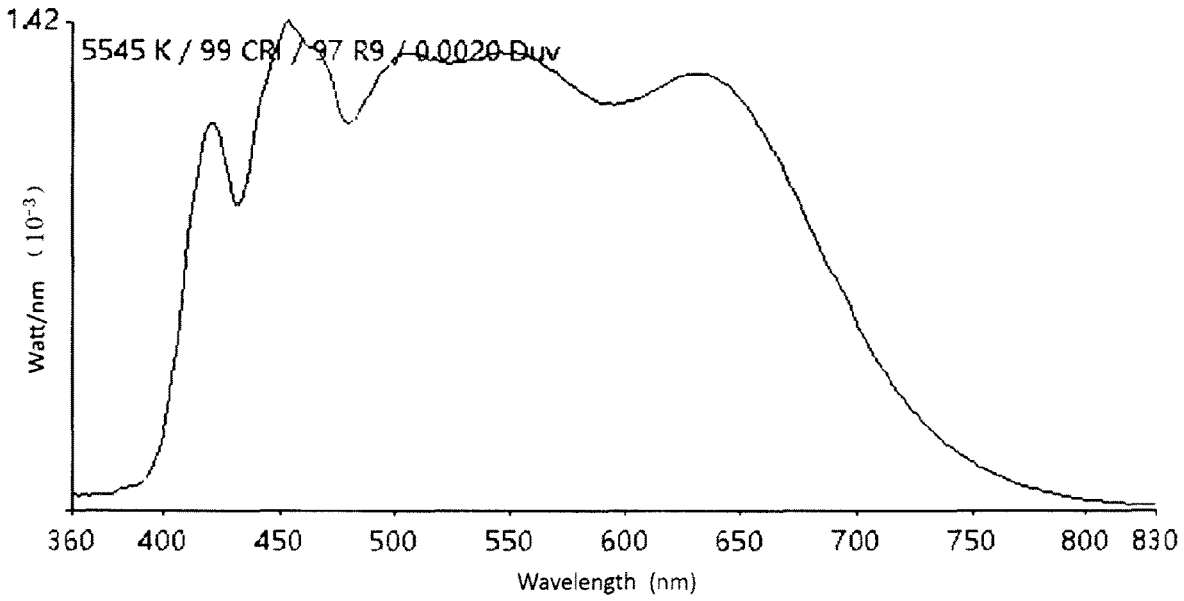
FIG. 17 is a spectrogram of a main control light source with color temperature of 5545K according to an embodiment of the present invention.
Figure 18:
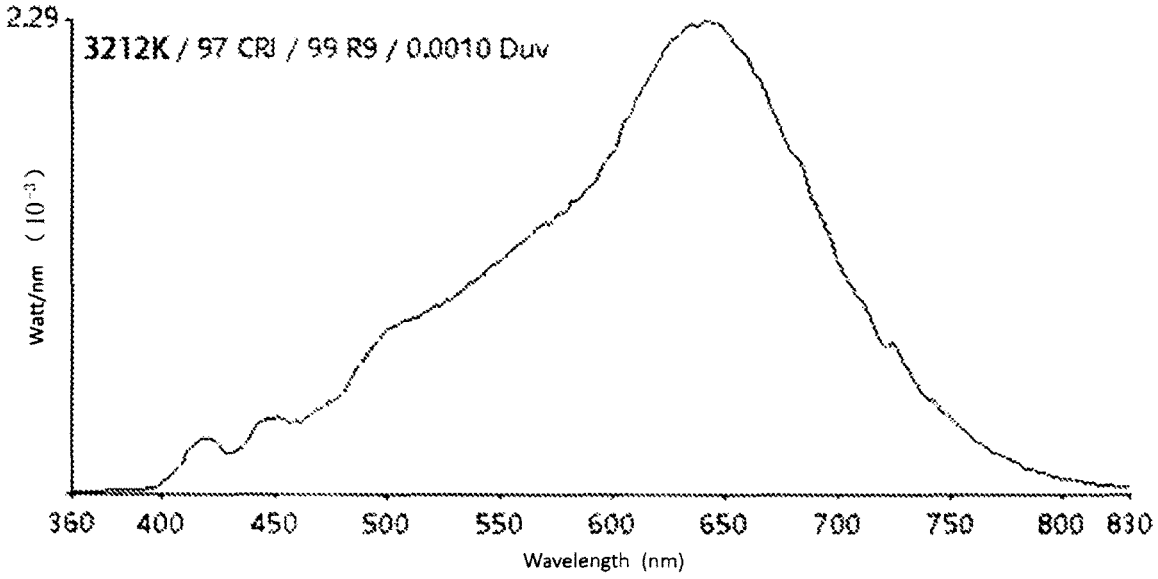
FIG. 18 is a spectrogram of another main control light source with color temperature of 3212K according to an embodiment of the present invention.
Figure 19:
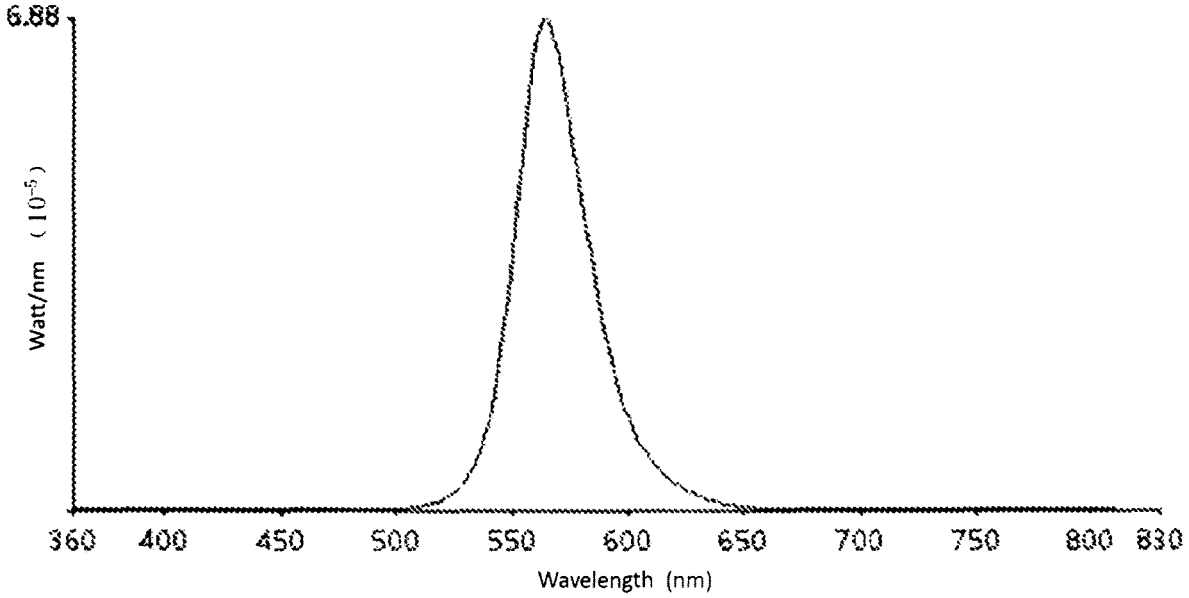
FIG. 19 is a chart diagram illustrating an auxiliary light source with wavelength of 570 nm according to the present invention.
Figure 20:
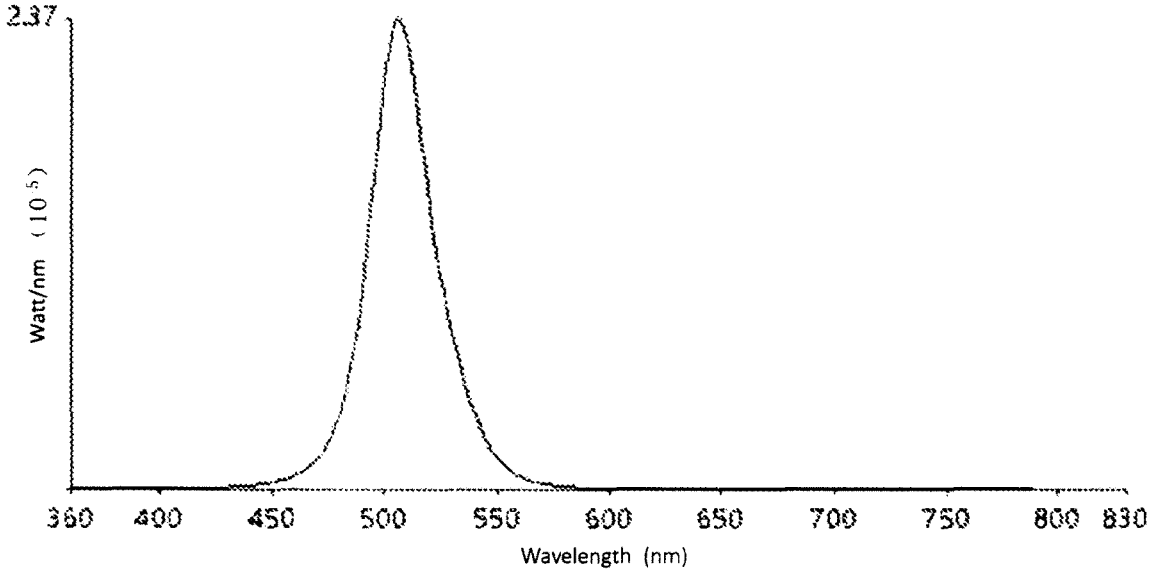
FIG. 20 is a chart diagram illustrating an auxiliary light source with wavelength of 505 nm according to the present invention.
Figure 21:
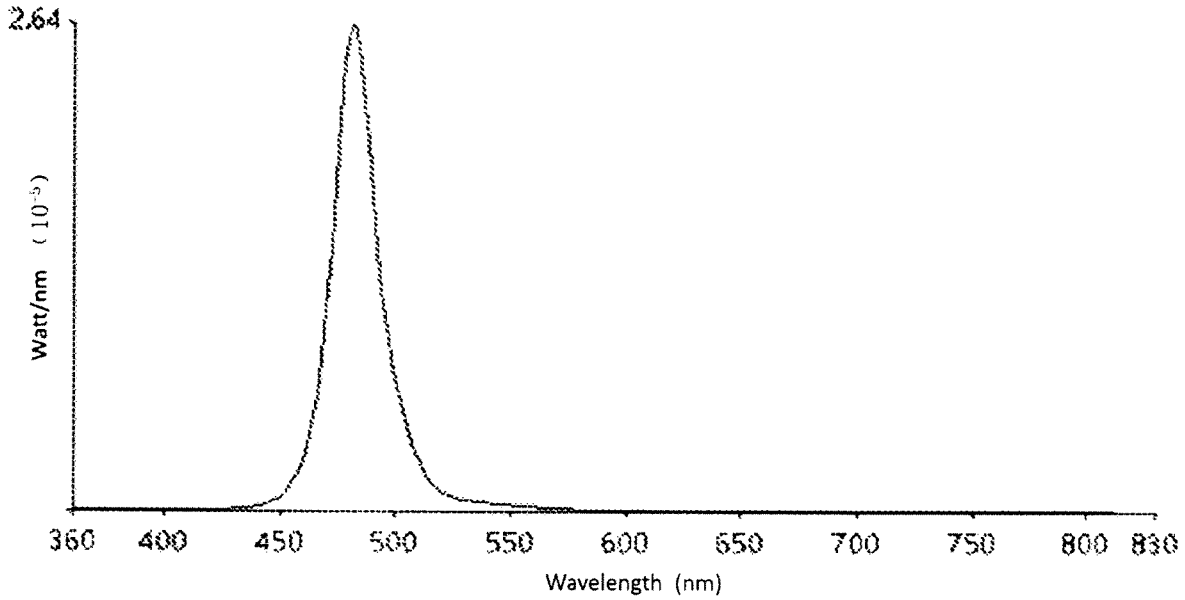
FIG. 21 chart diagram illustrating an auxiliary light source with wavelength of 484 nm according to the present invention.

FIG. 17 is a spectrogram illustrating a main control light source with color temperature of 5545K according to an embodiment of the present invention. FIG. 18 is a spectrogram of another main control light source with color temperature of 3212K according to an embodiment of the present invention. The spectrogram of the main control light source is generally close to a solar spectrum, which mostly has a better quality of light. FIG. 19 illustrates an auxiliary light source with a wavelength of 570 nm. FIG. 20 illustrates an auxiliary light source with a wavelength of 505 nm. FIG. 21 illustrates an auxiliary light source with a wavelength of 484 nm. It can be noted that the auxiliary light source is a light source with a relatively narrow waveband, and the spectrum of the auxiliary light source is less than the spectrum of the main control light source, and the light quality of the auxiliary light source is slightly worse.

Figure 22:
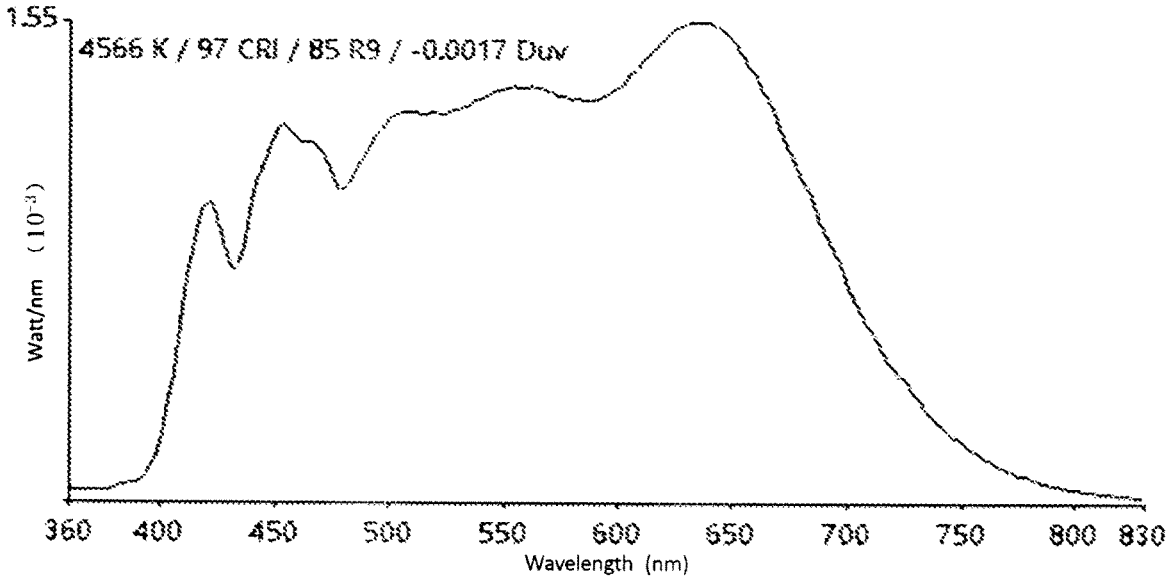
FIG. 22 is a spectrogram of a mixed light without adding an auxiliary light source according to an embodiment of the present invention.
Figure 23:
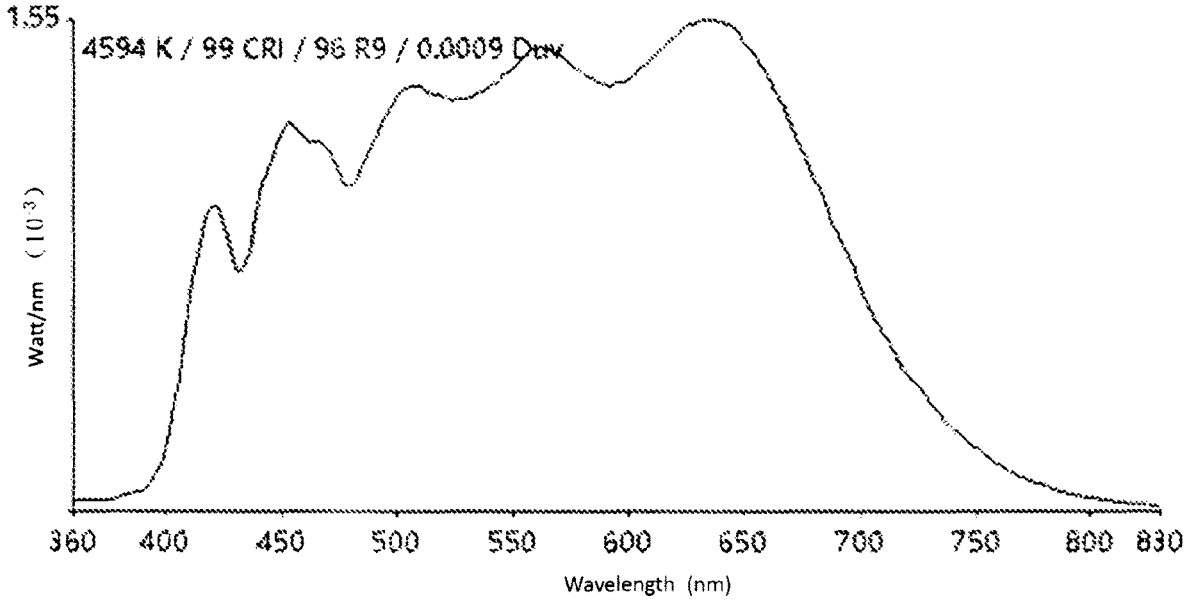
FIG. 23 is a spectrogram of a mixed light with an auxiliary light source added according to an embodiment of the present invention.

FIG. 22 illustrates a light mixing spectrogram of an unadded auxiliary light source according to an embodiment of the present invention, wherein it can be seen according to the comparison of the spectrum of the mixed light to that of the main control light source that the light quality of the mixed light without adding the auxiliary light source is relatively poor. FIG. 23 illustrates a light mixing spectrum of an auxiliary light source added according to an embodiment of the present invention. It can be seen from FIG. 23 that the spectrum of the mixed light obtained through the method can simulate a near sunlight spectrum more accurately, and the obtained mixed light also has a higher light quality.

FIG. 24 illustrates a table of simulated data of mixed light without adding an auxiliary light source according to an embodiment of the present invention. FIG. 25 is a perspective view of simulated data of mixed light adding an auxiliary light source according to an embodiment of the present invention. Meanwhile, since the spectrum is relatively complex, the spectrum of the mixed light can be evaluated with reference to FIG. 23 and FIG. 24. It can be found that on the basis of the main control light source, the auxiliary light source is added, and the proportional relationship between the luminous flux between the multiple light sources is adjusted, so that the obtained spectrum evaluation parameters of the target mixed light can be greatly improved. For example, the color rendering index-CRIRa, color rendering index-CRIR9, color rendering index-CRIR12, light quality index-CQSQa, television lighting consistency index-TLCI, and fidelity index-Rf are all greatly improved, and are close to the spectrum evaluation parameters of the main control light source.

According to another embodiment of the present invention, the embodiment of the present invention further provides another test data for light mixing adjustment, wherein the main control light sources include a first light source with a color temperature of 4001K and a second light source with a color temperature of 2675K, and the auxiliary light sources may include a third light source with a wavelength of 570 nm, a fourth light source with a wavelength of 505 nm, and a fifth light source with a wavelength of 484 nm. It is also set that the color coordinate range in the first preset light quality range is that the color coordinate path of the target mixed light is below the black body path, and the color coordinate path is equidistant from the black body path. The specific light mixing adjustment condition is consistent with the above, which details are not repetitively described herein.

A person skilled in the art may clearly understand that, for convenience and brevity of description, the specific working process of the above mentioned devices may refer to the corresponding process in the above mentioned method, which details are not repetitively described herein.

In short, the embodiment of the present application provides a light mixing adjustment method, device and system as well as a storage medium. The light mixing adjustment method comprises steps of:

acquiring at least two main control light sources and at least two auxiliary light sources; and adjusting the proportional relation of luminous flux between the at least two main control light sources and the at least two auxiliary light sources to obtain target mixed light with a target color temperature, so that the color coordinates of the target mixed light are within the preset color coordinate range.

The target mixed light is obtained by mixing the at least two main control light sources and the at least two auxiliary light sources, and the total luminous flux of all the main control light sources is greater than the total luminous flux of all the auxiliary light sources. According to the embodiment of the present application, at least two auxiliary light sources are added based on the at least two main control light sources, and the proportional relation of luminous flux between a plurality of light sources is adjusted, so that the plurality of light sources can be mixed to obtain target mixed light satisfying the demands.

For the embodiments provided by the present invention, it should be understood that the disclosed devices and methods may also be implemented in other manners. The devices the embodiments described above are merely illustrative. For example, the flowchart and block diagrams in the figures illustrate the architecture, functionality, and operation of possible implementations of devices, methods, and computer program products according to various embodiments of the present invention. In this regard, each block in a flow or block diagram may represent a module, segment, or portion of code, a module, a program segment, or a portion of code comprising one or more executable instructions configured to implement a specified logical function. It should also be noted that, in some alternative implementations, the functions noted in the blocks may occur out of the order noted in the figures. For example, two blocks shown in succession may, in fact, be executed substantially concurrently, or they may sometimes be executed in the reverse order, depending upon the functionality involved. It should also be noted that each block and combinations of blocks in a block diagram and/or flow diagram illustration, may be implemented with dedicated hardware-based systems that perform the specified functions or acts, or may be implemented with special purpose hardware and combinations of computer instructions.

In addition, functional modules in the embodiments of the present invention may be integrated together to form an independent part, or each module may exist alone, or two or more modules may be integrated to form an independent part.

When implemented in the form of a software functional module and sold or used as an independent product, the functions may be stored in a computer-readable storage medium. Based on such an understanding, the technical solution of the present invention essentially or a part of the technical solution that contributes to the prior art or a part of the technical solution may be embodied in a form of a software product, and the computer software product is stored in a storage medium, which comprises several instructions to allow a computer device (which may be a personal computer, a server, or a network device, etc.) to perform all or part of the steps of the method of the embodiments of the present invention. The above mentioned storage medium includes various media that can store program codes, such as a USB flash disk, a mobile hard disk, a Read-Only Memory (ROM), a Random Access Memory (RAM), a diskette, an Compact Disc, and etc.

The above is only a part of the embodiments of the present invention, and is not intended to limit the present invention, and for a person skilled in the art, the present invention may have various modifications and variations. Any modifications, equivalent substitutions, improvements and the like made within the spirit and principle of the present invention shall fall within the protection scope of the present invention. It should be noted that similar reference numerals and letters indicate similar items in the drawings, and therefore, once a certain item is defined in one figure, it is not necessary to further define and interpret it in the subsequent figures.

The above are only specific embodiments of the present invention, but the scope of protection of the present invention shall not be limited thereto, and any changes or substitutions can be easily conceived of by a person skilled in the art within the technical scope of the present disclosure shall all fall within the protection scope of the present invention. Therefore, the protection scope of the present invention shall be subject to the protection scope of the claims.

It should be noted that relational terms, such as first, second, and etc., are used herein to distinguish one entity or operation from another entity or operation without necessarily requiring or implying any such actual relationship or order between these entities or operations. Moreover, the terms "comprising," "including," or any other variation thereof, are intended to cover a non-exclusive inclusion, such that a process, method, article, or device that includes a series of elements not only includes those elements, but also includes other elements not expressly listed, or elements inherent to such a process, method, article, or device. In the absence of more restrictions, the limitation of the phrase "includes one" on an element does not exclude the presence of additional identical element in the process, method, article, or device of that element.

INDUSTRIAL APPLICABILITY

According to the embodiment of the present application, at least two auxiliary light sources are added on the basis of at least two main control light sources, and the proportional relation of luminous flux between a plurality of light sources is adjusted, so that the plurality of light sources can be mixed to obtain target mixed light satisfying the demands.

Besides, it allows the obtained target mixed light to achieve the expected goal through arranging a preset color coordinate range.

Besides, the proportional relation of the luminous flux between the auxiliary light sources is adjusted, so that the spectrum evaluation parameters of the target mixed light are within a preset spectrum evaluation parameter range, which ensures that the target mixed light has a high quality optical quality parameter.

Besides, by presetting the proportional relation of the luminous flux between the main control light sources and adjusting the proportional relation of the auxiliary light sources, the proportional relation of the luminous flux between the plurality of main control light sources and the plurality of auxiliary light sources can be adjusted more quickly, and the target mixed light can be obtained more efficiently.

Besides, if it still fails to obtain a target mixed light, after the proportional relation of the luminous flux between the auxiliary light sources has been adjusted several times, it allows the adjusting mode to be changed, to obtain the target mixed light more quickly and more efficiently.

What is claimed is:

1. A light mixing adjustment method, comprising:

acquiring at least two main control light sources and at least two auxiliary light sources;

adjusting a proportional relation of luminous flux between the at least two main control light sources and the at least two auxiliary light sources to obtain a target mixed light with a target color temperature through mixing the at least two main control light sources and the at least two auxiliary light sources such that color coordinates of the target mixed light are within a preset color coordinate range, wherein a total luminous flux of the at least two main control light sources is greater than a total luminous flux of the at least two auxiliary light sources; and if spectral evaluation parameters of the target mixed light are not within a preset spectral evaluation parameter range, adjusting the proportional relation of luminous flux between a plurality of auxiliary light sources, such that the spectral evaluation parameters of the target mixed light fall within the preset spectral evaluation parameter range, wherein when the spectral evaluation parameters of the target mixed light are within the preset spectral evaluation parameter range, values of a plurality of light quality evaluation parameters of the target mixed light are greater than or equal to values of the plurality of light quality evaluation parameters of at least one of the at least two main control light sources;

the plurality of light quality evaluation parameters comprising a color rendering index-CRIRa, a color rendering index-CRIR9, a color rendering index-CRIR12, a light quality index-CQSQa, a television lighting consistency index-TLCI, and a fidelity index-Rf, values of the light quality evaluation parameters of the target mixed light being greater than or equal to the values of the light quality evaluation parameters of at least one of the at least two main control light sources:

values of the color rendering index-CRIRa of the target mixed light being greater than or equal to at least one of the values of the color rendering index-CRIRa of the at least two main control light sources;

values of the color rendering index-CRIR9 of the target mixed light being greater than or equal to at least one of the values of the color rendering index-CRIR9 of the at least two main control light sources;

values of the color rendering index-CRIR12 of the target mixed light being greater than or equal to at least one of the values of the color rendering index-CRIR12 of the at least two main control light sources;

values of the light quality index-CQSQa of the target mixed light being greater than or equal to at least one of the values of the light quality index-CQSQa of the at least two main control light sources;

values of the television lighting consistency index-TLCI of the target mixed light being greater than or equal to at least one of the values of the television lighting consistency index-TLCI of the at least two main control light sources;

values of the fidelity index-Rf of the target mixed light being greater than or equal to at least one of the values of the fidelity index-Rf of the at least two main control light sources.

2. A light mixing adjustment method, comprising:

acquiring at least two main control light sources and at least two auxiliary light sources; and adjusting a proportional relation of luminous flux between the at least two main control light sources and the at least two auxiliary light sources to obtain a target mixed light with a target color temperature through mixing the at least two main control light sources and the at least two auxiliary light sources such that color coordinates of the target mixed light are within a preset color coordinate range, wherein a total luminous flux of the at least two main control light sources is greater than a total luminous flux of the at least two auxiliary light sources, wherein the step of adjusting the proportional relation of the luminous flux between the at least two main control light sources and the at least two auxiliary light sources comprises:

adjusting the proportional relation of the luminous flux between the at least two auxiliary light sources based on a preset proportional relation of the luminous flux between the at least two main control light sources; and if the target mixed light is not obtained when a number of times of the step of adjusting the proportional relation of the luminous flux between the at least two auxiliary light sources reaches a preset number of times or a duration of the step of adjusting the proportional relation of the luminous flux between the at least two auxiliary light sources reaches a preset time, fine tuning the proportional relation of the luminous flux between the at least two main control light sources, and adjusting the proportional relation of the luminous flux between the at least two auxiliary light sources again based on the proportional relation of the luminous flux between the at least two main control light sources after the step (i), so as to obtain the target mixed light.

* * * * *